US007117765B1

(12) United States Patent
Wallden

(10) Patent No.: US 7,117,765 B1
(45) Date of Patent: Oct. 10, 2006

(54) COLOR CODED TOOL KIT AND METHODS

(76) Inventor: Russell C. Wallden, 1840 256th St., Aldergrove, BC (CA) V4W 2J9

( * ) Notice: Subject to any disclaimer, the term of this patent is extended or adjusted under 35 U.S.C. 154(b) by 60 days.

(21) Appl. No.: 10/819,065

(22) Filed: Apr. 6, 2004

(51) Int. Cl.
*B25B 13/46* (2006.01)
*B25B 13/00* (2006.01)
*B25B 21/00* (2006.01)

(52) U.S. Cl. ..... 81/60; 81/DIG. 5; 81/52

(58) Field of Classification Search ..... 81/DIG. 5
See application file for complete search history.

(56) References Cited

U.S. PATENT DOCUMENTS 4,455,898 A * 6/1984 Marbourg, Jr. ..... 81/454
4,982,627 A * 1/1991 Johnson ..... 81/121.1
5,031,488 A 7/1991 Zumeta
5,079,978 A * 1/1992 Kupfer ..... 81/119
5,181,439 A * 1/1993 Schwartz ..... 81/119
5,330,230 A 7/1994 Craig
D374,892 S 10/1996 Nalepka et al.
5,957,012 A * 9/1999 McCune ..... 81/180.1
6,082,227 A * 7/2000 Vogel ..... 81/119
6,257,098 B1 * 7/2001 Cirone ..... 81/119
6,668,751 B1 * 12/2003 Henke ..... 116/200
6,761,093 B1 * 7/2004 Chang ..... 81/121.1
2004/0016324 A1 * 1/2004 Wright ..... 81/121.1
2005/0132847 A1 * 6/2005 Garg ..... 81/121.1

OTHER PUBLICATIONS

Sears, Roebuck and Co., Craftsman Mechanics' Tools Catalog, Aug. 30, 1955, p. 3.*

* cited by examiner

*Primary Examiner*—Joseph J. Hail, III
*Assistant Examiner*—Bryan R. Muller

(57) ABSTRACT

A tool kit having at least one ratchet and at least two sets of sockets. Each ratchet having a first color coded indicia indicating the size of the driver on each particular ratchet. The first, and the second set of sockets having on each socket, the first color coded indicia indicating the size of the particular driver hole marked at the drive end of each socket, as well as, having the second color coded indicia for indicating the particular size and point configuration of the nut hole of the particular socket marked at the nut hole end of that particular socket.

3 Claims, 4 Drawing Sheets

COLOR CODED TOOL KIT AND METHODS

FIELD OF THE INVENTION

The preset invention relates generally to the field of identification systems for tools, more particularly, to the field of visual color coding systems for identifying the specific features of a tool and size of the tool.

DESCRIPTION OF THE PRIOR ART

In the field of automotive repair, wide varieties of differently sized tools, particularly sockets and handled ratchets, are required. Each socket has at least two sizes to be fitted. The first size to be fitted is the driver hole of the socket to be coupled to a driver of a given ratchet. The second size to be fitted is the nut hole of the socket to be fitted over a nut or a bolt head for eventual tightening or loosening. Because of the wide diversity of nuts and bolts, coupled with the greasy, dirty and often times darkened environment of automobile repair, the mechanic is often challenged to accomplish the apparently simple task of locating the proper socket/ratchet combination to perform a given task.

The art of identifying the size of the tool comprise a stamped indicia indicating the nut hole size. Other techniques have been to color code the nut hole sizes on various tools. However, the inventor is unaware of a tool kit identification art, which identifies the driver hole size of a given socket. Furthermore, the inventor is unaware of a tool kit identification, which teaches to mark both the nut size hole and the driver size hole onto a respective socket. Even further yet, the inventor is unaware of a tool kit identification art form, which teaches to mark the nut hole size, the driver size hole and the number of sides, which define the nut hole in a given socket.

A wide variety of tool size identification techniques are currently available on the commercial market and an even larger number of these types of devices are known in the art of tool size identification, for example, the color coded tools disclosed by Johnson in U.S. Pat. No. 4,982,627; the color coding system disclosed by Zumeta in U.S. Pat. No. 5,031,488; the double-coded wrenches and sockets disclosed by Kupfer in U.S. Pat. No. 5,079,978; the kit for identifying individually sized implements disclosed by Craig in U.S. Pat. No. 5,330,230; the visual coding system for tool size disclosed by Vogel in U.S. Pat. No. 6,082,227; and the set of color coded labels for organizing books disclosed by Nalepka and Bunn in U.S. Pat. No. D374,892. While all of the above-described devices fulfill their respective, particular objectives and requirements, the aforementioned patents do not describe a color coded tool kit for with a first and a second color coded indicia marked on each socket and a first color coded indicia marked on a ratchet. This type of marking on tools would specifically match the user's particular individual needs of making it possible to visually match from the first color coded indicia the size of the ratchet driver to the size of the driver hole in the socket, as well as, visually match from the second color coded indicia, the nut size, along with, visually match from the width of the second color coded indicia, the number of internal sides of any socket within the kit.

Therefore, a need exist for a new and improved color coded tool kit that can be used by an individual to visually match a given socket with a given ratchet and a given nut by inspecting the first color coded indicia that indicates the size of the ratchet driver to the size of the driver hole in the socket, as well as, visually match from the second color coded indicia the nut size along with, the number of internal sides of any socket within the kit. In this respect, the color coded tool kit according to the preset invention substantially departs from the conventional concepts and designs of the prior art, and in doing so provides an apparatus primarily developed for the purpose of allowing a user to match the appropriate drive size of a socket to the corresponding ratchet, along with, fitting the correct nut hole size, as well as, the appropriate number of internal sides on the bolt that the user desires to work.

SUMMARY OF THE INVENTION

The preset device, according to the principles of the preset invention, overcomes the shortcomings of the prior art by providing a new and improved tool kit which allows a user, at a glance, to visually determine the particular nut hole size, along with, the number of internal sides of a given socket, as well as, the particular driver hole of the same given socket in order to conveniently find the corresponding ratchet having the matching first color coded indicia. The kit comprises at least one ratchet and at least two sets of sockets. Each ratchet having a first color coded indicia indicating the size of the driver on each particular ratchet. The first and second sets of sockets having on each socket the first color coded indicia indicating the size of the particular driver hole marked at the drive end of each socket, as well as, having a second color coded indicia for indicating the number of internal sides, along with indicating the particular size of the nut hole of the particular socket marked at the nut hole end of that particular socket. Thereby, the color coded tool kit allows a user to visually identify, from the various indicia marked on the tool pieces, the sizes of the various drive hole fittings, as well as, the sizes of the nut hole, along with, the various number of internal sides in each socket based on the color coded indicia.

In view of the foregoing disadvantages inherent in the known type ratchet socket type tool kits now preset in the prior art, the present invention provides an improved color coded tool kit, which will be described subsequently in great detail, is to provide a new and improved color coded tool kit which is not anticipated, rendered obvious, suggested, or even implied by the prior art, either alone or in any combination thereof.

To attain this, the preset invention essentially comprises at least one ratchet and at least two sets of sockets. Each ratchet having a first color coded indicia indicating the size of the driver on each particular ratchet. The first and second sets of sockets having on each socket the first color coded indicia indicating the size of the particular driver hole marked at the drive end of each socket, as well as, having a second color coded indicia, which displays the number of internal sides, along with indicating the particular size of the nut hole of the particular socket marked at the nut hole end of that particular socket.

There has thus been outlined, rather broadly, the more important features of the invention in order that the detailed description thereof that follows may be better understood, and in order that the present contribution of the art may be better appreciated.

The invention may also include the variable width of the second color coded indicia to be proportional to the number of sides of an open-end and box-end of a combination wrench. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved color coded tool kit that has all the advantages of the prior color coded tool art and none of the disadvantages.

It is another object of the present invention to provide a new and improved color coded tool kit that may be easily and efficiently manufactured and marketed.

An even further object of the present invention is to provide a new and improved color coded tool kit that has a low cost of manufacture with regard to both materials and labor, and which accordingly is then susceptible of low prices of sale to the consuming public, thereby making such multipurpose storage unit and system economically available to the buying public.

Still another object of the present invention is to provide a new color coded tool kit that provides in the apparatuses and methods of the prior art some of the advantages thereof, while simultaneously overcoming most of the disadvantages normally associated therewith.

It is also an object of the present invention to provide a new and improved method of making a color coded tool kit from an existing tool set for allowing a user to visually identify the sizes of the various fittings of the tools in the tool kit 10. Briefly, the method of making the color coded tool kit 10 comprises the steps of obtaining, attaching, adding, adhering, adjoining, and affixing.

Lastly, it is an object of the present invention to provide a new and improved method of using a color coded tool kit for allowing a user to visually identify the sizes and features of the tools in the tool kit 10. Briefly, the method of using the color coded tool kit 10 comprises the steps of obtaining, identifying, looking, selecting, matching, loosening, locating, searching, finding, correlating, connecting, tightening.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
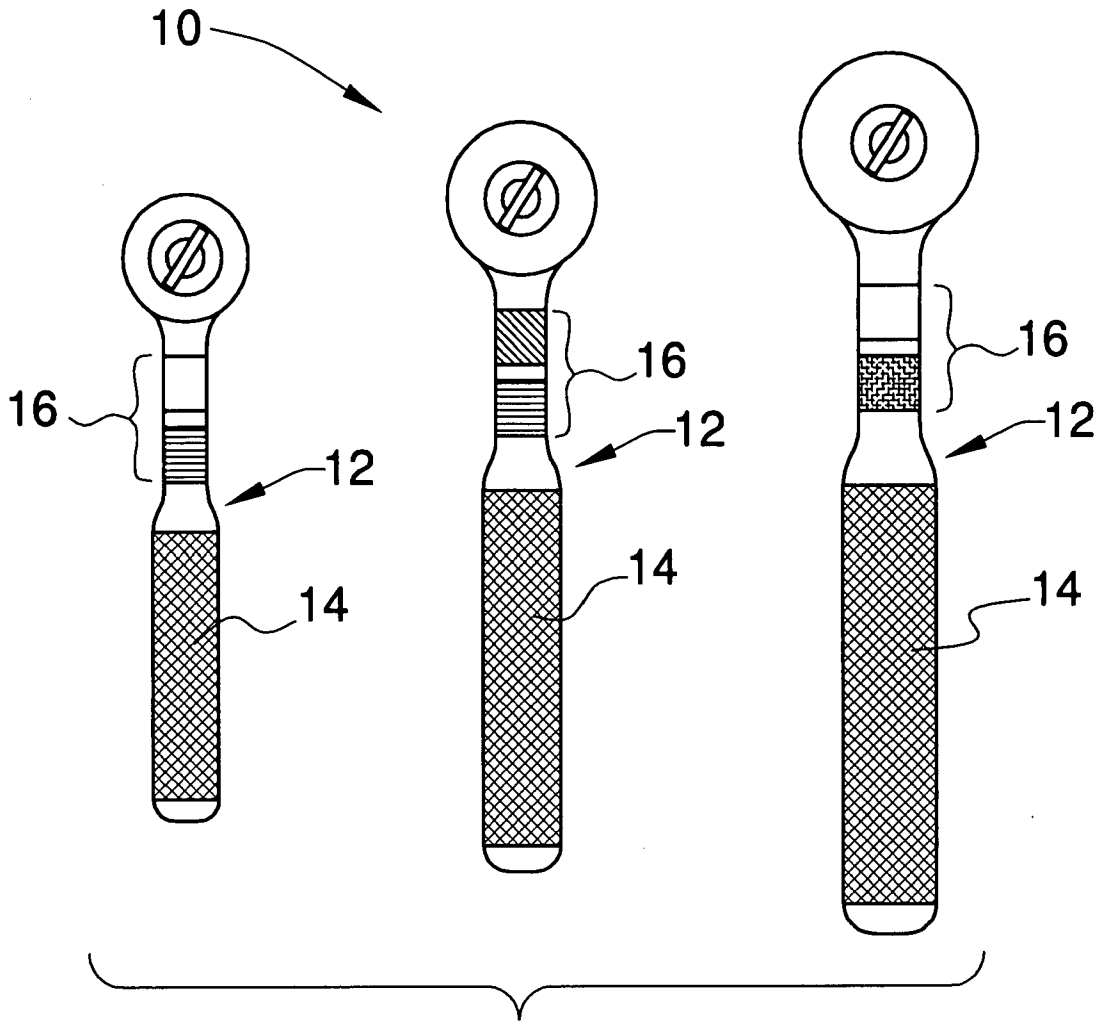
FIG. 1 is a rear view of a set of ratchets of one of the preferred embodiments of the color coded tool kit constructed in accordance with the principles of the present invention.
Figure 2:
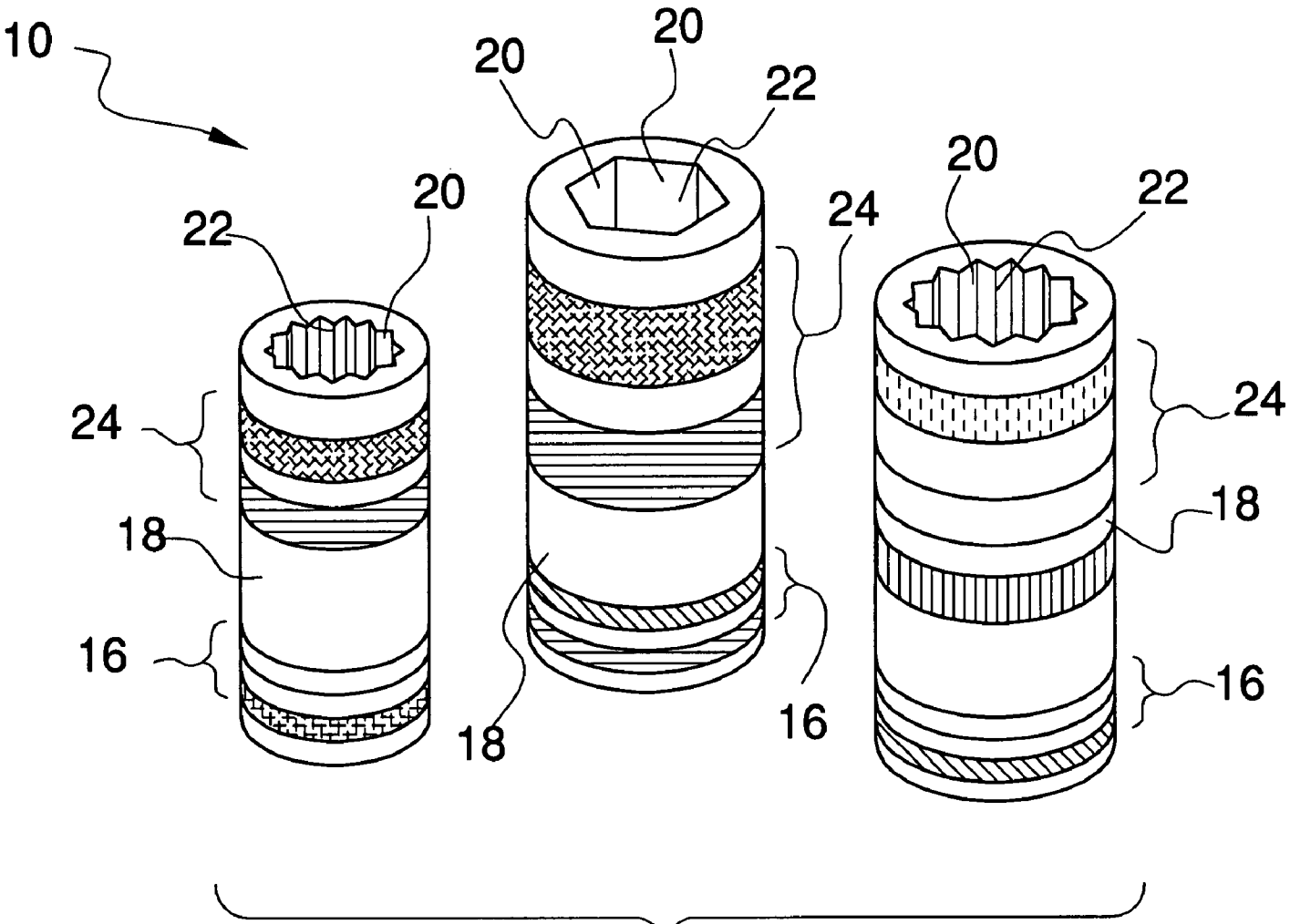
FIG. 2 is perspective view of three sockets of one of the preferred embodiments of the color coded tool kit of the present invention.
Figure 3:
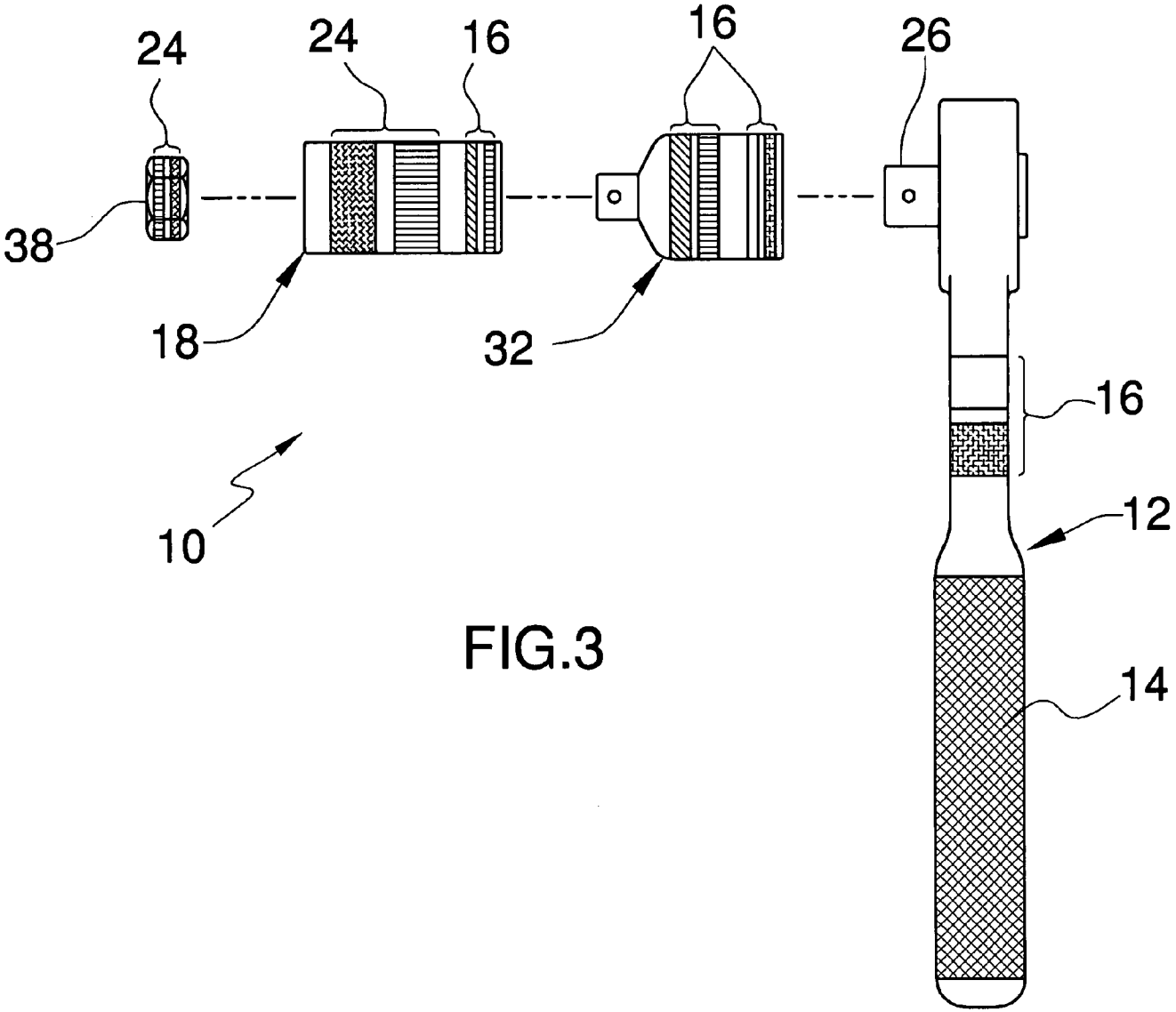
FIG. 3 is a side view of the one of the preferred embodiments of the color coded tool kit of the present invention.
Figure 4:
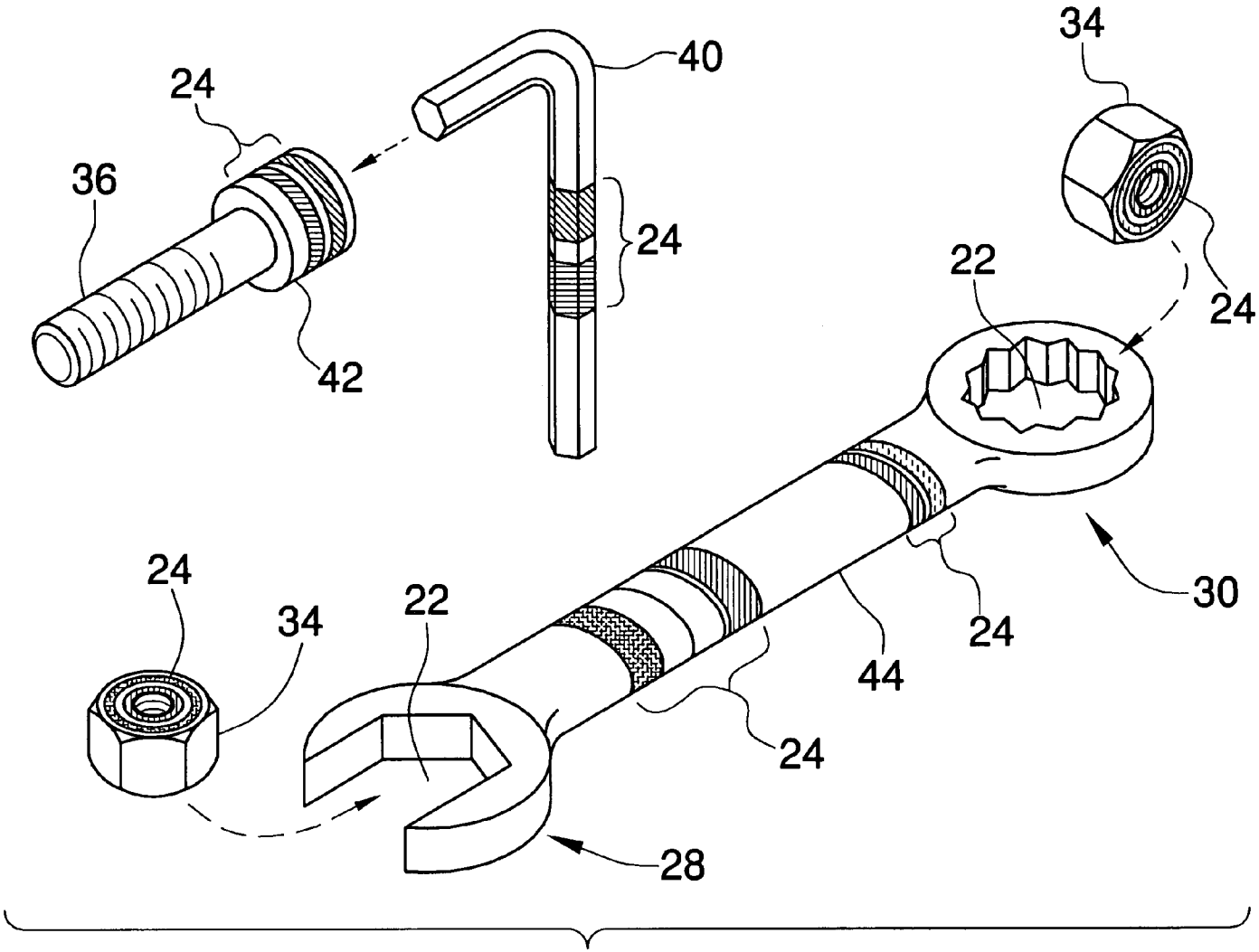
FIG. 4 is a perspective view of one of the preferred embodiments of the color coded tool kit of the present invention.

Referring now to the drawings, and in particular FIGS. 1 to 4 thereof, one preferred embodiment of the present invention is shown and generally designated by the reference numeral 10. One embodiment of the present invention of a color coded tool kit 10 for allowing a user to visually identify the sizes of the various fittings of the tools in the color coded tool kit 10 comprises: a ratchet set; a six point socket set; and a second, twelve point socket set. The ratchet set having at least one ratchet 12. Each ratchet 12 in the ratchet set includes: a handle 14; a driver 26; and a first color coded indicia 16 attached to each handle 14 for indicating the corresponding driver 26 size of each ratchet 12 in the ratchet set. Each socket 18 in the six point socket set having a first number of internal sides 20 defining the nut hole 22 in each socket 18 in the six point socket set. The six point socket set is composed of at least one socket 18. Each socket 18 of the six point socket set includes: the first color coded indicia 16 attached to the drive end portion of each socket 18 in the six point socket set for indicating the corresponding driver hole size of each socket 18 in the six point socket set; and a second color coded indicia 24 attached to the forward nut hole portion of each socket 18 in the six point socket set for indicating the number of internal sides 20, as well as, indicating the corresponding nut hole 22 size of each socket 18 in the six point socket set.

Each socket 18 in the second, twelve point socket set having a second number of internal sides 20 defining the nut hole 22 in each socket 18 in the second, twelve point socket set. The second, twelve point socket set is composed of at least one socket 18. Each socket 18 of the second, twelve point socket set includes: the first color coded indicia 16 attached to the rear drive portion of each socket 18 in the second, twelve point socket set for indicating the corresponding driver hole size of each socket 18 in the second, twelve point socket set; and the second color coded indicia 24 attached to the forward nut hole portion of each socket 18 in the second, twelve point socket set for indicating the number of internal sides 20, as well as, indicating the corresponding nut hole 22 size of each socket 18 in the second, twelve point socket set.

The second color coded indicia 24 attached to any socket 18 of the color coded tool kit 10 may optionally comprise multiple annular bands. The first color coded indicia 16 attached to any socket 18 in any of the socket sets may optionally comprise a pair of annular bands. The first color coded indicia 16 may optionally be recessed into the drive end of the socket; along with the second color coded indicia 24 may optionally be recessed into the nut hole end of the socket.

An optional third, spline socket set may be added to the color coded tool kit 10. Each spline socket 18 in the third spline socket set having a third number of internal sides 20 defining the nut hole 22 in each spline socket 18 in the third spline socket set. The third spline socket set composed of at least one spline socket 18. Each spline socket 18 of the third spline socket set includes: the first color coded indicia 16 attached to the rear drive portion of each socket 18 in the third spline socket set for indicating the corresponding driver hole size of each spline socket 18 in the third spline socket set; and the second color coded indicia 24 attached to the forward nut hole portion of each spline socket 18 in the third spline socket set for indicating the spline socket configuration, as well as, indicating the corresponding nut hole 22 size of each spline socket 18 in the third spline socket set.

An optional first color coded indicia 16 may be attached to the nut hole end of the spline socket 18 for indicating the spline socket number, which is inherent to that particular spline socket.

An optional open-end wrench set may be added to the color coded tool kit 10. The open-end wrench set having at least one open-end wrench. Each open-end wrench of the open-end wrench set includes: a first and a second end; the second color coded indicia 24 attached to the first end of each open-end wrench for indicating from the open end feature, as well as, indicating the corresponding size of the nut 34 that fits in the associated first end of each open-end wrench; and the second color coded indicia 24 attached to the second end of each open-end wrench for indicating the open end feature, as well as, indicating the corresponding size of the nut 34 that fits in the associated second end.

An optional box-end wrench set may be added to the color coded tool kit 10. The box-end wrench set having at least one box-end wrench. Each box-end wrench of the box-end wrench set includes: a first and a second end; the second color coded indicia 24 attached to the first end of each box-end wrench for indicating the number of internal sides, as well as, indicating the corresponding nut hole 22 size of the associated first end of each box-end wrench; and the second color coded indicia 24 attached to the second end of each box-end wrench for indicating the number of internal sides, as well as, indicating the corresponding nut hole 22 size of the associated second end of each box-end wrench.

An optional combination wrench set may be added to the color coded tool kit 10. The combination wrench set having at least one combination wrench 44. Each combination wrench 44 of the combination wrench set includes: a first open-end 28 and a second box-end 30; each open end of the combination wrench displaying the second color coded indicia 24 having a given width of indicia for indicating the corresponding open end 28 feature, as well as, indicating by color the corresponding nut opening size 28 of that particular open end, and a second color coded indicia 24 attached to the box end of each combination wrench 44 for indicating the nut hole 22 size, as well as, having a given width of the second color coded indicia 24 for indicating the number of internal sides of that particular box-end wrench of the combination wrench set.

An optional driver adapter set may also be added to the color coded tool kit 10. The optional driver adapter set having at least one driver adapter 32. Each driver adapter 32 of the driver adapter set includes: the first color coded indicia 16 attached to the rear drive portion of each driver adapter 32 for indicating the corresponding driver hole size of each driver adapter 32; and the first coded color coded 16 indicia attached to the forward, prong end of each driver adapter 32 for indicating the corresponding driver prong size of each driver adapter 32.

An optional torque wrench set may also be added to the color coded tool kit 10. The optional torque wrench set having at least one torque wrench. Each torque wrench of the torque wrench set includes the first coded indicia attached each torque wrench for indicating the corresponding driver size 26 of each torque wrench.

An optional nut set may be also added to the color coded tool kit 10. The optional nut set having at least one nut, each nut 34 of the nut set having the second color coded indicia 24 attached to each nut 34 for indicating the corresponding size of each nut 34, as well as, each nut having a given width of the second color coded indicia for indicating the specific thread configuration of that particular nut.

An optional bolt set may also be added to the color coded tool kit 10. The optional bolt set having at least one bolt. Each bolt having the second color coded indicia 24 attached to each bolt for indicating the respective head size of each bolt, as well as, each bolt having a given width of the second color coded indicia for indicating the specific thread configuration of that particular bolt.

An optional screw set may be added to the color coded tool kit 10. The optional screw set having at least one screw 36. Each screw 36 includes: a head 42 with a collar defining a hexagonal orifice. Each screw having the second color coded indicia 24 attached to the head 42 of each screw for indicating the corresponding size of the hexagonal orifice on the associated head 42, as well as, each screw head 42 in the screw set having a given width of color coded indicia for specifying the thread configuration of that particular screw of the set of screws.

An optional hexagonal wrench set may be added to the color coded tool kit 10. The optional hexagonal wrench set having at least one hexagonal wrench 40. Each hexagonal wrench 40 of the hexagonal wrench set having the second color coded indicia 24 attached to each hexagonal wrench 40 of the hexagonal wrench set, for indicating the corresponding size of each hexagonal wrench 40 in the hexagonal wrench set.

One preferred method of making a color coded tool kit 10 for allowing a user to visually identify the sizes of the various fittings of the tools in the tool kit 10, the method of making the color coded tool kit 10 comprises: obtaining, attaching, adding, adhering, adjoining, and affixing.

The obtaining step comprises obtaining a tool set comprising: a ratchet set having at least one ratchet 12, wherein each ratchet 12 in the ratchet set includes: a handle 14; and a driver 26; a six point socket set wherein each socket 18 in the six point socket set having a first number of internal sides 20 defining the nut hole 22 in each socket 18 in the six point socket set, the six point socket set composed of at least one socket 18; a second, twelve point socket set wherein each socket 18 in the second, twelve point socket set having a second number of internal sides 20 defining the nut hole 22 in each socket 18 in the second, twelve point socket set, the second, twelve point socket set composed of at least one socket 18.

The attaching step comprises attaching a vinyl tape, powder coat, ionized or colored snap ring consisting of a first color coded indicia 16 around each handle 14 for indicating the corresponding driver 26 size of each ratchet 12 in the ratchet set.

The adding step comprises adding a vinyl tape, powder coat, ionized or colored snap ring consisting of the first color coded indicia 16 around the rear portion of each socket 18 in the six point socket set for indicating the corresponding driver hole size of each socket 18 in the six point socket set.

The adhering step comprises adhering a vinyl tape, powder coat, ionized or colored snap ring consisting of a second color coded indicia 24 around to the nut hole portion of each socket 18 in the six point socket set for indicating the corresponding nut hole 22 size of each socket 18 in the six point socket set; wherein the second color coded indicia 24 adhered around each socket 18 of the six point socket set having a width of the second color coded indicia which is indirectly proportional to the number of internal sides 20 defining the nut hole 22 of each of the sockets 18 in the six point socket set.

The adjoining step comprises adjoining a vinyl tape, powder coat, ionized or colored snap ring consisting of the first color coded indicia 16 around the rear portion of each socket 18 in the second, twelve point socket set for indicating the corresponding driver hole size of each socket 18 in the second, twelve point socket set.

The affixing step comprises affixing a vinyl tape, powder coat, ionized or colored snap ring consisting of the second color coded indicia 24 around the forward nut hole portion of each socket 18 in the second, twelve point socket set for indicating the corresponding nut hole 22 size of each socket 18 in the second, twelve point socket set, wherein the second color coded indicia 24 affixed around each socket 18 of the second, twelve point socket set having a width of the second color coded indicia which is indirectly proportional to the number of internal sides 20 defining the nut hole 22 of each of the sockets 18 in the second, twelve point socket set.

One preferred method of using a color coded tool kit 10 for allowing a user to visually identify the sizes of the various fittings of the tools in the tool kit 10, the method of using the color coded tool kit 10 comprises the steps of obtaining, identifying, looking, selecting, matching, attaching, loosening, locating, searching, finding, correlating, connecting, and tightening.

The obtaining step comprises obtaining the color coded tool kit 10, the color coded tool kit 10 comprising: a ratchet set having at least one ratchet 12, wherein each ratchet 12 in the ratchet set includes: a handle 14; a driver 26; and a first color coded indicia 16 attached to each handle 14 for indicating the corresponding driver 26 size of each ratchet 12 in the ratchet set; a six point socket set wherein each socket 18 in the six point socket set having a first number of internal sides 20 defining the nut hole 22 in each socket 18 in the six point socket set, the six point socket set composed of at least one socket 18, wherein each socket 18 of the six point socket set includes: the first color coded indicia 16 attached to the rear portion of each socket 18 in the six point socket set for indicating the corresponding driver hole size of each socket 18 in the six point socket set; a second color coded indicia 24 attached to the forward portion of each socket 18 in the six point socket set for indicating the corresponding nut hole 22 size of each socket 18 in the six point socket set; the width of the second color coded indicia 24 attached to each socket 18 in the six point socket set is proportional to the number of sides that define the corresponding nut hole 22 in each socket 18 in the six point socket set; and a second, twelve point socket set wherein each socket 18 in the second, twelve point socket set having a second number of internal sides 20 defining the nut hole 22 in each socket 18 in the second, twelve point socket set The second, twelve point socket set composed of at least one socket 18, wherein each socket 18 of the second, twelve point socket set includes: the first color coded indicia 16 attached to the rear portion of each socket 18 in the second, twelve point socket set for indicating the corresponding driver hole size of each socket 18 in the second, twelve point socket set; the second color coded indicia 24 attached to the forward portion of each socket 18 in the second, twelve point socket set for indicating the corresponding nut hole 22 size of each socket 18 in the second, twelve point socket set; and the width of the second color coded indicia 24 attached to each socket 18 in the second, twelve point socket set is proportional to the number of sides that define the corresponding nut hole 22 in each socket 18 in the second, twelve point socket set.

The identifying step comprises identifying a nut attached to a device that the user decides to loosen with a given socket 18 having the first number of internal sides 20 defining the nut hole 22 in the socket 18. The looking step comprises looking for the given socket 18 with a second color coded indicia 24 with a given width attached to the given socket 18 in the six point socket set which has a nut hole 22 that fits around the nut. The selecting step comprises selecting the given socket 18 from the six point socket set which fits around the nut. The matching step comprises matching the first color indicia on the rear portion of the given socket 18 to the first color indicia on a given ratchet 12 from the ratchet set. The attaching step comprises attaching the given socket 18 to the given ratchet 12. The loosening step comprises loosening the nut with the given socket 18 attached to the given ratchet 12. The locating step comprises locating a bolt attached to the device that the user decides requires to be tightened with a socket 18 having the second number of internal sides-20 defining the nut hole 22 in a particular socket 18. The searching step comprises searching for the particular socket 18 with the second color coded indicia 24 with a particular width attached to the particular socket 18 in the second, twelve point socket set which has a nut hole 22 that fits around the bolt. The finding step comprises finding the particular socket 18 from the second, twelve-point socket set which fits around the bolt. The correlating step comprises correlating the first color indicia on the rear portion of the particular socket 18 to the first color indicia on a particular ratchet 12 from the ratchet set. The connecting step comprises connecting the particular socket 18 to the particular ratchet 12. The tightening step comprises tightening the bolt with the particular socket 18 connected to the particular ratchet 12. The indicating means for indicating the size of the driver prong of each corresponding ratchet in the ratchet set comprises: a one fourth inch ratchet driver, having a first white annular band, a space, and a second light blue annular band; a three eights inch ratchet driver, having a first green band, a space, and a second purple band; a one half inch ratchet driver having a first white band, a space, and a second yellow band. The indicating means for indicating the size of the driver adapter of the driver adapter set comprises the following:

A three eights inch drive hole, reduced to a one fourth inch drive prong, having a first white annular band, a space, and a second light blue annular band around the prong end of the driver adapter, so as to indicate the one fourth inch driver reducer prong width, as well as, a first green band, a space, and a second purple band around the driver hole end of the driver adapter, so as to indicate the driver hole width. A one half inch driver hole reduced to a three eights inch driver prong, having a first white annular band, a space, and a second yellow band around the driver hole end of the driver adapter, so as to indicate the driver hole width, as well as, a first green annular band, a space, and a second purple annular band around the prong end of the driver adapter, so as to indicate the three eights inch driver reducer prong width.

The determining means for determining the driver hole width in each socket of the socket set comprises the following: The driver hole end of each socket of the socket set with a one fourth inch driver hole width, having the first indicia placed on the outer recessed perimeter of the drive hole, a first white annular band, a space, and a second light blue annular band. The drive hole end of each socket of the socket set with a three eights inch driver hole width having the first indicia placed on the outer recessed perimeter of the drive hole, a first green band, a space, and a second purple band. The drive hole end of each socket of the socket set with a one half inch driver hole width having the first indicia placed on the outer recessed perimeter of the drive hole, a first white band, a space and a second yellow band. The determining means for determining the width of the driver orifice of each driver extension of the driver extension set comprises the following: The drive hole end of each driver extension of the driver extension set with a one fourth inch driver orifice width having the indicia placed on the outer recessed perimeter, a first white annular band, a space, and a second light blue annular band. The drive hole end of each driver extension of the driver extension set with a three eights inch driver orifice width having the first indicia placed on the outer recessed perimeter of the drive hole, a first green band, a space, and a second purple band. The drive hole end of each driver adapter extension of the driver extension set with a one half inch driver orifice width having the indicia placed on the outer recessed perimeter of the drive end, a first white band, a space and a second yellow band.

In this color coded tool identification scheme, the first colored indicia indicates the drive size of any given socket, adapter or extension, as well as, the thread/pitch count of a given tap or die, along with indicating the number inherent to a spline socket. The second color coded indicia indicates the nut hole width of a socket and box end wrench, along with the nut hole point number of a socket or box end wrench, and differentiates the socket or wrenches standard or metric nut hole calibration type. Thereby, this color coded tool identification scheme provides a convenient and rapid means of a visual scan of the set varied width and color of said first and second color coded indicia. Therefore, all pertinent information the user is requiring concerning sizes and features of the specific tool as described herein, becomes evident, with one look.

The color coded tool identification system is applicable on any number of standard and metric tools. The combinations of colored bands, placement, and width of bands represent the different sizes and features; for metric and standard open-end wrenches, 6-point sockets and box-end wrenches, 12-point sockets and box-end wrenches, spline box-end wrenches and sockets, hex screws, nuts, bolts, taps and dies, and indicates drive size for ratchets, sockets, extensions, and adapters. This color coded tool identification system uses various widths of colored bands and spacing to display all features of a given hand tool. Specifically, the sockets are identified by (1) Drive size, (2) Nut hole diameter, and (3) Point features of socket. The open wrenches and box-end wrenches are identified by (1) Size of wrench, (2) Box-end feature, (3) Open-end feature, and (4) Point configuration of box-end. The Ratchets are identified by the (1) Drive size. The extensions are identified by the (1) Drive size. The adapters are identified by the (1) Adapter to ratchet drive size, and the (2) Adapter to socket drive size. The nuts and bolts are identified by the (1) Nut or bolt size and the (2) Thread pattern (i.e., coarse or fine threads). The tap and die sets are identified by the (1) Diameter of the Tap and die hole diameter, (2) the thread pattern (coarse or fine thread), and (3) Pitch/thread count.

The band value demarcations are represented by the T-F-S-D-L-P-I bands.

The (T) band has eight features. The (T) band is the widest band at approximately ¼ inch wide. First, a single colored (T) band will represent one numeral. Second, a singular (T) or a (T) band adjoined to an additional (T) band indicates a metric open-end of a wrench. Third, the (T) band indicates the standard open-end of a wrench when adjoined to the (S) band and adjoined to one or more additional (T) bands. Fourth, it indicates a spline configuration while working in conjunction with (S) and (T) band/s. Fifth, it indicates a 6-point metric, socket or box-end when singular or adjoined to the (F) band. Sixth, indicates a 6-point standard socket or box-end while working in conjunction with the (S) and (F) band/s. Seventh, the (T) band indicates metric fine thread, on a nut or bolt, tap and die when singular or adjoined to the (F) band. Eighth, it indicates standard fine thread on a nut or bolt, tap and die while working in conjunction with (S) and (F) band/s.

The space (S) between one or more colored bands represents a fraction (/) measurement, often used in standard measurements. This (S) space will be half as wide as the (T) band.

The (F) band has five features. First, a single colored (F) band will represent one numeral. Second, alone on a socket or box end wrench, the (F) band will represent a 12 point single digit metric size 1–9 mm, when adjoined to an additional (F) band will represent a 2-digit metric size 10–99 mm. Third, it indicates the standard 12 point feature of sockets and box end wrenches while working in conjunction with (S) and additional (F) band/s. Fourth, it indicates standard coarse thread on nuts and bolts, taps and dies while working in conjunction with the (S) and additional (F) band/s. Fifth, the (F) band indicates metric coarse thread on nuts and bolts taps and dies, singular or while working in conjunction with an additional adjoined (F) band. The (F) band will be identical in width to that of the (S) band, as well as, being one half the width of the (T) band.

The (P) band represents the decimal point on a metric measurement; adjoined, as a black band between singular and multiple colored indicia. The width of the (P) band is approximately 1/10th the width of the (T) band.

The (D) band has five features. First, a single colored (D) band indicates one numeral by its color. Second, it indicates drive size, by placement, generally accompanied by the (L) band and an additional (D) band. Example: ¼ drive, ⅜ drive, ½ drive. (D.L.D.). Third, it represents a decimal number on a metric size, when adjoined after (T.P.), or (F.P.), example (F.P.D.), (F.T.P.D.), (T.P.D.), or (T.T.P.D.). Forth, the (D) band will indicate the specific torx number, T40, T45, T50 and as an example (D.D.) when applied to the upper portion of a torx tool. Fifth, it indicates pitch/thread count on metric and standard taps and dies.

*Spline sockets and box end wrenches my optionally comprise the (D) band/s to indicate the spline number affixed to each individual spline tool. Example (D) 1-digit or (D.D.) 2-didgits. The (D) band is one half the thickness of the (F) band.

The (L) band represents the space between the two (D) bands, which represents a fraction indicator for the drive size indicia, e.g. (D.L.D.). The (L) space thickness is equal to (D) band thickness.

The (I) line (black in color, red on impact tools) may be used in standard and metric measurement as a distinguisher between two identical colors such as 11, 22, 33; the (I) line will also be adjoined onto each end of the standard one inch, white (T), (F), or (D) band, the width of the (I) line is approximately 1/20th the width of the (T) band.

As the formula of the color-coded tool kit 10 is applied to different hand tools, the values of the indicia will differ depending on the particular tool the indicia is applied to. For example, to indicate a six point configuration, a thick band of color (T), a space (S), and a thin band of color (F), on any given socket or box end wrench (T.S.F.), will indicate the six-point nut hole configuration. The colors on the (T) band, and on the (F) band represent numerals. The space (S) between the colored bands represents the fraction indicator, thus the colors of the bands indicate (in numerals) the diameter of the nut hole of a six-point box-end wrench or six-point socket in a fraction measurement. A thin band of color (F), a space (S), and an identical thin band of color (F) on any given socket or box end wrench (F.S.F.) will indicate the twelve-point configuration for a socket or box end wrench. The identical widths of bands and spacing, (as the six-point socket) (T.S.F.) applied to a nut, bolt, tap or die will indicate the fine thread configuration of that particular nut, bolt, tap or die. The colors of the (T) and (F) indicia represent numerals, the space (S) between the colors representing the fraction indicator, thus indicating, by color, a 2 digit fractional size, i.e. 1/2, 1/4, 7/8, diameter for a bolt, or nut head, as well as, the same fractional size diameter of a tap or internal die diameter, as well as indicating by width of colored bands-(T.S.F), the same fine thread configuration as the nut and bolt.

For standard tools, the varied width of indicia is always displayed above the fraction (S) indicator.

For ratchets, sockets, extensions, and adapters the drive sizes are indicated by the (D) colored indicia-(L) space-(D) colored indicia. The indicia (D.L.D.) will typically read for 1/4" drive, 3/8" drive, 1/2" drive and 3/4" in drive. The one inch drive will display the (D) indicia, white in color to represent numeral one highlighted by a black (I) line on both sides of the white drive line indicator. Red (I) lines will be used on one-inch impact sockets. The width of drive size indicia (D.L.D.) will vary on a socket/ratchet or extensions in relation to size of that particular tool such as the 1/4, 1/2, 3/8 drive size using the (D.L.D.) indicia and the one inch drive using the (I.D.I.) indicia.

The coded application for standard thread includes the following scheme. The standard fine thread—nuts/bolts—taps/dies, which have 2 digits, i.e.: 1/4, 3/8, 1/2, 5/8, 3/4, 7/8 use the (T.S.F.) indicia. The standard fine thread—nuts/bolts—taps/dies, which have 3 digits, i.e. 5/16, 7/16, and 9/16, use the (T.S.F.F.) indicia. The standard fine thread—nuts/bolts—taps/dies which have 4 digits, i.e. 13/16, 15/16 use the (F.T.S.F.F.) indicia, except the 11/16 standard fine thread nuts/bolts-taps/dies uses the (F.I.T.S.F.F.) indicia.

The coded application for standard coarse thread nuts/bolts-taps/dies includes the following scheme. The standard coarse thread nuts/bolts-taps/dies, which have 2 digits, i.e. 1/4, 3/8, 1/2, 5/8, 7/8, etc use, the (F.S.F) indicia. The standard coarse thread—nuts/bolts—taps/dies, which have 3 digits, i.e.: 5/16, 7/16, 9/16 uses the (F.S.F.F.) indicia. The standard coarse thread—nuts/bolts—taps/dies, which have 4 digits, i.e. 13/16, 15/16 (F.F.S.F.F.) indicia, except 11/16, which uses the (F.I.F.S.F.F.) indicia.

The coded application for thread/tooth counts on the taps and dies include the following scheme. A tap or die will display the (D) color coded indicia to indicate the thread count from 1 to 9 threads per set increments of standard or metric measurement. A tap or die will display the (D.D.) color coded indicia for a thread count from 10 to 99 threads per set increments of standard or metric measurement.

The coded applications for metric thread tools include the following scheme. For metric thread tools the combinations of width and color of the color-coded indicia represent the different sizes and features for coarse and fine thread. For example, when this system is applied to a fine threaded 10 mm nut, bolt, tap or die, the fine white (F) band, adjoined to a thick black (T) band—(F.T.) will represent the fine thread of the nut, bolt, tap or die, and as the white and black indicia are adjoined this will represent the numeral ten. A 10 mm/fine thread. Another example would be when this system is applied to a coarse threaded 10 mm nut, bolt, tap or die. The fine white (F) band will now be adjoined to a fine black (F) band, thus (F.F.) 10 mm/coarse thread, is obtained. This configuration will represent the coarse thread of the nut, bolt, tap or die, and as the white and black indicia are adjoined this will represent the numeral ten.

The coded application for metric thread includes the following scheme. For metric fine thread—nuts/bolts—taps/dies having one digit, i.e., 1–9 mm a (T) band is the indicia. For metric fine thread—nuts/bolts—taps/dies having two digits, i.e., 10–99 mm a (F.T.) band is the indicia, except fine thread—nuts/bolts—taps/dies having two identical digits where the (F.I.T.) band is the indicia.

The coded application for metric coarse thread—nuts/bolts—taps/dies includes the following scheme. For metric coarse thread—nuts/bolts—taps/dies having one digit, i.e., 1–9 mm a (F) band is the indicia. For metric coarse thread—nuts/bolts—taps/dies having two digits, i.e., 10–99 mm a (F.F.) band is the indicia, except coarse thread—nuts/bolts—taps/dies having two identical digits where the (F.I.F.) band is the indicia.

A metric tap or die will display the (D) color coded indicia to indicate the thread count from 1 to 9 threads per set increments of metric measurement. A metric tap or die will display a (D.D.) color coded indicia for a thread count from 10 to 99 threads per set increments of metric measurement, except having two identical digits where the (D.I.D.) band is the indicia. The coded applications for color coded standard hand tools include the following scheme. For standard open-end wrench having a single digit, e.g., 1 inch a (I.T.I) band is used as the indicia. For standard open-end wrench having two digits, i.e.: 1/4, 3/8, 1/2, 5/8, 7/8 etc. a (T.S.T) band is used as the indicia. For standard open-end wrench having three digits, i.e.: 5/16, 7/16, 9/16 a (T.S.T.T.) band is used as the indicia. For standard open-end wrench having four digits, i.e.: 13/16, 15/16 a (T.T.S.T.T.) band is used as the indicia except where the standard open-end wrench having four digits is 11/16, which uses a (T.I.T.S.T.T.) band as the indicia. For 6 point box-end wrench and socket having a single digit, e.g., 1 inch, a (I.T.I.) band is used as the indicia. For 6 point-box-end wrench and sockets having 2 digits, i.e.: ¼, ⅜, ½, ⅝, ¾, ⅞ a (T.S.F.) band is used as the indicia. For 6 point-box-end wrench and socket having 3 digits, i.e.: 5/16, 7/16, and 9/16 a (T.S.F.F.) band is used as the indicia. For 6 point-box-end wrench and socket having 4 digits, i.e.: 13/16, 15/16 a (F.T.S.F.F.) band is used as the indicia, except where the 6 point-box-end wrench and socket has 4 digits which is 11/16 in which a (F.I.T.S.F.F.) band is used as the indicia. For 12 point box-end wrench and socket having a single digit, i.e.: 1 inch, a (I.F.I.) band is used as the indicia. For 12 point box-end wrench and socket having 2 digits, i.e.: ¼, ⅜, ½, ⅝, ⅞ etc a (F.S.F.) band is used as the indicia. For 12 point box-end wrench and sockets having 3 digits, i.e.: 5/16, 7/16, and 9/16 a (F.S.F.F.) band is used as the indicia. For 12 point box-end wrench and sockets having 4 digits, i.e.: 13/16, 15/16 a (F.F.S.F.F.) band is used as the indicia except where the 12 point box-end wrench or socket is 11/16 where a (F.I.F.S.F.F.) band is used as the indicia.

The coded application for color coded spline hand tools includes the following scheme. For spline box end wrenches having a 1 digit spline size, 2 digit diameter: #8-¼ a (D.L.T.S.T) band is used as the indicia. For spline box end wrenches having a 1 digit spline size, 3 digit diameter: #7-7/32, #9-9/32 a (D.L.T.S.T.T.) band is used as the indicia. For spline box end wrenches having a 2 digit spline size, 2 digit diameter: #12-⅜, #16-½, a (D.D.L.T.S.T.) band is used as the indicia. For spline box end wrenches having a 2 digit spline size, 3 digit diameter: #10-5/16, #18-9/16 a (D.D.L.T-.S.T.T.) band is used as the indicia. For spline box end wrenches having a 2 digits spline size, 4 digit diameter: #26-13/16 a (D.D.L.T.T.S.T.T) band is used as the indicia. For spline box end wrenches having #22-11/16 a (D.I.D.L.T.I.T-.S.T.T) band is used as the indicia.

The coded application for color coded metric hand tools includes the following scheme. For open-end metric wrench having 1 digit, 1–9 mm, a (T.) band is used as the indicia. For open-end metric wrench having 1 digit, a decimal, 1 digit, a (T.P.D.) band is used as the indicia. For open-end metric wrench having 2 digits, 10–99 mm, a (T.T.) band is used as the indicia, except where 2 digits of identical color are used then the (T.I.T.) band is the indicia. For open-end metric wrench having 2 digits, a decimal, 1 digit, a (T.T.P.D) band is used as the indicia, except where 2 digits of identical color are used before the decimal point, then the (T.I.T.P.D) band is the indicia. For 6 point metric box-end wrench/sockets having 1 digit, 1–9 mm, a (T.) band is used as the indicia. For 6 point metric box-end wrench/sockets having 1 digit, a decimal, 1 digit, a (T.P.D.) band is used as the indicia. For 6 point metric-box-end wrench/sockets having 2 digits, 10–99 mm, a (F.T.) band is used as the indicia. For 6 point metric-box-end wrench/sockets having 2 digits, a decimal, 1 digit, a (F.T.P.D) band is used as the indicia. Except where 2 digits of identical color are used before the decimal point, then the (F.I.T.P.D.) band is the indicia. For 12 point metric-box-end wrench/sockets having 1 digit, 1–9 mm, a (F) band is used as the indicia. For 12 point metric-box-end wrench/sockets having 1 digit, decimal, 1 digit, a (F.P.D.) band is used as the indicia. For 12 point metric box-end wrench/sockets having 2 digits, 10–99 mm, a (F.F.) band is used as the indicia. For 12 point metric box-end wrench/sockets having 2 digits, a decimal, 1 digit, a (F.F.P.D.) band is used as the indicia. Except where 2 digits of identical color are used before the decimal point, then the (F.I.F.P.D.) band is the indicia.

The coded application for hand tools includes the following scheme, used to distinguish metric from standard tools. For metric tools, the varied width of indicia will be displayed on the lower portion of double-digit indicia. For standard tools, the varied width of indicia will be displayed above the fraction (S) indicator. For standard open-end wrenches the indicia bands of, I.T.I., T.S.T., T.S.T.T., T.T.S.T.T., and T.I.T.S.T.T., are used as compared to metric open-end wrenches (up to 99.9 mm), which employ the indicia bands of, T., T.T., T.I.T, T.P.D., T.T.P.D. and T.I.T.P.D. For standard hex keys (up to one inch) the indicia bands of, I.T.I., T.S.F., T.S.F.F., F.T.S.F.F., and F.I.T.S.F.F. are used as compared to metric hex keys (up to 99.9 mm) which employ the indicia bands of T., T.P.D., F.T., F.I.T., F.T.P.D. and F.I.T.P.D. For standard 6-point socket/box-end (up to one inch) the indicia bands of, I.T.I., T.S.F., T.S.F.F., F.T.S.F.F. and F.I.T.S.F.F are used, as compared to metric 6-point socket/box-end (up to 99.9 mm), which employ the indicia bands of, T., T.P.D., F.T., F.I.T., F.T.P.D., and F.I.T.P.D. For standard 12 point socket/box-end (up to one inch) the indicia bands of I.F.I., F.S.F., F.S.F.F., F.F.S.F.F., and F.I.F.S.F.F., are used as compared to metric 12 point socket/box-end (up to 99.9 mm), which employ the indicia bands of, F., F.P.D., F.F., F.I.F., F.F.P.D., and F.I.F.P.D. For fine thread standard tools (up to one inch) the indicia bands of, I.T.I., T.S.F., T.S.F.F., F.T.S.F.F., and F.I.T.S.F.F are used as compared to fine thread metric tools (up to 99.9 mm), which employ the indicia bands of T., T.P.D., F.T., F.I.T., F.T.P.D. and F.I.T.P.D. For coarse thread standard tools (up to one inch) the indicia bands of, I.F.I., F.S.F., F.S.F.F., F.F.S.F.F. and F.I.F.S.F.F. are used as compared to coarse thread metric tools (up to 99.9 mm), which employ the indicia bands of, F., F.P.D., F.F., F.I.F., F.F.P.D., and F.I.F.P.D. bands.

By applying this system of color and widths, the user will be able to identify the (1) tool size, (2) drive size, (3) open end, (4) box end, (5) 6 point, (6) 12 point, (7) spline, (8) metric, (9) standard, (10) coarse thread, (11) fine thread, and the (12) pitch/thread count. This formula for identifying the given features of the particular tools as described herein may vary slightly in respect to width of indicia, to meet the needs of a specific manufacture. It is important to note that the "width" of the bands will be relative to the size of the tool, so as the tool decreases in size so will the bands of color. This will be in especially important in manufacturing, as it will make the colored bands uniform in relation to the length or size of the tool.

EXAMPLE 1

Standard Six-Point Socket Set

The distal end of a six point ¼ inch socket having a first band colored white having a width of a set thickness; a space having a width of half of the set thickness; and a second band colored light blue having a width of half of the set thickness. The distal end of a six point 5/16 inch socket having a first band colored orange having a width of the set thickness; a space having a width of half of the set thickness; a second band colored white having a width of half of the set thickness; adjoined to a third band colored red having a width of half of the set thickness. The distal end of a six point ⅜ inch socket having a first band colored green having a width of the set thickness; a space having a width of half of the set thickness; and a second band colored purple having a width of half of the set thickness. The distal end of a six point 7/16 inch socket having a first band colored gold having a width of the set thickness; a space having a width of half the set thickness; a second band colored white having a width of half of the set thickness; adjoined to a third band colored red having a width of half of the set thickness. The distal end of a six point ½ inch socket having a first band colored white having a width of the set thickness; a space having a width of half of the set thickness; and a second band colored yellow having a width of half of the set thickness. The distal end of a six point 9/16 inch socket having a first band colored dark blue having a width of the set thickness; a space having a width of half of the set thickness; a second band colored white having a width of half of the set thickness; adjoined to a third band colored red having a width of half of the set thickness. The distal end of a six point ⅝ inch socket having a first band colored orange having a width of the set thickness; a space having a width of half of the set thickness; and a second band colored purple having a width of half of the set thickness. The distal end of a six point 11/16 inch socket having a first band colored white having a width of half of the set thickness; adjoined to a black band having a width of one twentieth the set thickness; adjoined to a third band colored white having a width of the set thickness; a space having a width of half of the set thickness; a forth band colored white having a width of half of the set thickness; adjoined to a fifth band colored red having a width of half of the set thickness. The distal end of a six point ¾ inch socket having a first band colored green having a width of the set thickness; a space having a width of half of the set thickness; and a second band colored light blue having a width of half of the set thickness. The distal end of a six point 13/16 inch socket having a first band colored white having a width of half of the set thickness; adjoined to a second band colored green having a width of the set thickness; a space having a width of half of the set thickness; a third band colored white having a width of half of the set thickness; adjoined to a fourth band colored red having a width of half of the set thickness The distal end of a six point ⅞ inch socket having a first band colored gold having a width of the set thickness; a space having a width of half of the set thickness; and a second band colored purple having a width of half of the set thickness. The distal end of a six point 15/16 inch socket having a first band colored white having a width of half of the set thickness; adjoined to a second band colored orange having a width of the set thickness; a space having a width of half of the set thickness; a third band colored white having a width of half of the set thickness; adjoined to a fourth band colored red having a width of half of the set thickness. The distal end of a six point, one inch, socket having a first band colored black having a width one twentieth of the set thickness; adjoined to a second band colored white having the set thickness; adjoined to a third band colored black having a width one twentieth of the set thickness

EXAMPLE 2

Standard Eight-Point Socket Set

The distal end of an eight point ¼ inch socket having a first line colored white having a width of the set thickness; a space; and a second line colored light blue having a width of the set thickness. The distal end of an eight point ⅜ inch socket having a first line colored green having a width of the set thickness; a space; and a second line colored purple having a width of the set thickness. The distal end of an eight point ½ inch socket having a first line colored white having a width of the set thickness; a space; and a second line colored yellow having a width of the set thickness. The distal end of an eight point 5/16 inch socket having a first line colored orange having a width of the set thickness; a space; a second line colored white having a width of the set thickness; and a third line colored red having a width of the set thickness. The distal end of an eight point 7/16 inch socket having a first line colored gold having a width of the set thickness; a space; a second line colored white having a width of the set thickness; and a third line colored red having a width of the set thickness. The distal end of an eight point 9/16 inch socket having a first line colored dark blue having a width of the set thickness; a space; a second line colored white having a width of the set thickness; and a third line colored red having a width of the set thickness

EXAMPLE 3

Standard Twelve-Point Socket Set

The distal end of a twelve point ¼ inch socket having a first band colored white having a width of half of the set thickness; a space having a width of half of the set thickness; adjoined to a second band colored light blue having a width of half of the set thickness. The distal end of a twelve point 5/16 inch socket having a first band colored orange having a width of half of the set thickness; a space having a width of half of the set thickness; a second band colored white having a width of half of the set thickness; adjoined to a third band colored red having a width of half of the set thickness. The distal end of a twelve point ⅜ inch socket having a first band colored green having a width of half of the set thickness; a space having a width of half of the set thickness; and a second band colored purple having a width of half of the set thickness. The distal end of a twelve point 7/16 inch socket having a first band colored gold having a width of half of the set thickness; a space having a width of half of the set thickness; a second band colored white having a width of half of the set thickness; adjoined to a third band colored red having a width of half of the set thickness. The distal end of a twelve point ½ inch socket having a first band colored white having a width of half of the set thickness; a space having a width of half of the set thickness; and a second band colored yellow having a width of half of the set thickness. The distal end of a twelve point 9/16 inch socket having a first band colored dark blue having a width of half of the set thickness; a space having a width of half of the set thickness; a second band colored white having a width of half of the set thickness; adjoined to a third band colored red having a width of half of the set thickness. The distal end of a twelve point ⅝ inch socket having a first band colored orange having a width of half of the set thickness; a space having a width of half of the set thickness; and a second band colored purple having a width of half of the set thickness. The distal end of a twelve point 11/16 inch socket having a first band colored white having a width of half of the set thickness; adjoined to a black band one twentieth of the set thickness; adjoined to a third band colored white having a width of half of the set thickness; a space having half the set thickness; a forth band colored white having a width of half of the set thickness; adjoined to a fifth band colored red having a width of half of the set thickness. The distal end of a twelve point ¾ inch socket having a first band colored green having a width of half of the set thickness; a space having a width of half of the set thickness; and a second band colored light blue having a width of half of the set thickness. The distal end of a twelve point 13/16 inch socket having a first band colored white having a width of half of the set thickness; adjoined to a second band colored green having a width of half of the set thickness; a space having a width of half of the set thickness; a third band colored white having a width of half of the set thickness; adjoined to a fourth band colored red having a width of half of the set thickness. The distal end of a twelve point ⅞ inch socket having a first band colored gold having a width of half of the set thickness; a space having a width of half of the set thickness; and a second band colored purple having a width of half of the set thickness.

The distal end of a twelve point 15/16 inch socket having a first band colored white having a width of half of the set thickness; adjoined to a second band colored orange having a width of half of the set thickness; a space having a width of half of the set thickness; a third band colored white having a width of half of the set thickness; adjoined to a fourth band colored red having a width of half of the set thickness. The distal end of a twelve point one inch socket having a first band colored black having a width one twentieth of the set thickness; adjoined to a second band colored white having width one half the set thickness; adjoined to a third band colored black having a width one twentieth of the set thickness. The distal end of a twelve point one inch, Impact socket having a first band colored red having a width one twentieth of the set thickness; adjoined to a second band colored white having width one half the set thickness; adjoined to a third band colored red having a width one twentieth of the set thickness.

EXAMPLE 4

Metric Six-Point Socket Set

The distal end of a six point metric socket containing one digit will display single color-coded indicia having a width of the preset thickness, so as to indicate the six point feature. The distal end of a six point 4 mm socket having one band colored light blue having a width of the preset thickness. The distal end of a six point 4.5 mm socket having a first band colored light blue having a width of the preset thickness; adjoined to a second black band having a width one tenth the preset thickness; adjoined to third band colored orange having a width of one fourth the set thickness. The distal end of a six point 5 mm socket having one band colored orange having a width of the preset thickness The distal end of a six point 5.5 mm socket having a first band colored orange having a width of the preset thickness; adjoined to a second black band having a width one tenth the preset thickness; adjoined to third band colored orange having a width of one fourth the preset thickness. The distal end of a six point 6 mm socket having one band colored red having a width of the preset thickness. The distal end of a six point 7 mm socket having one band colored gold having a width of the preset thickness.

The distal end of a six point 8 mm socket having one band colored purple having a width of the preset thickness. The distal end of a six point 9 mm socket having one band colored dark blue having a width of the preset thickness. The distal end of a six point 10 mm socket having a first band colored white having a width of half the preset thickness; adjoined to a second band colored black having a width of the preset thickness. The distal end of a six point 11 mm socket having a first band colored white having a width of half the preset thickness; adjoined to a second black band one twentieth the preset thickness; adjoined to a third band colored white having a width of the preset thickness. The distal end of a six point 12 mm socket having a first band colored white having a width of half the preset thickness; adjoined to a second band colored yellow having a width of the preset thickness. The distal end of a six point 13 mm socket having a first band colored white having a width of half the preset thickness; adjoined to a second band colored green having a width of the preset thickness. The distal end of a six point 14 mm socket having a first band colored white having a width of half the preset thickness; adjoined to a second band colored light blue having a width of the preset thickness. The distal end of a six point 15 mm socket having a first band colored white having a width of half the preset thickness; adjoined to a second band colored orange having a width of the preset thickness. The distal end of a six point 16 mm socket having a first band colored white having a width of half the preset thickness; adjoined to a second band colored red having a width of the preset thickness. The distal end of a six point 17 mm socket having a first band colored white having a width of half the preset thickness; adjoined to a second band colored gold having a width of the preset thickness. The distal end of a six point 18 mm socket having a first band colored white having a width of half the preset thickness; adjoined to a second band colored purple having a width of the preset thickness. The distal end of a six point 19 mm socket having a first band colored white having a width of half the preset thickness; adjoined to a second band colored dark blue having a width of the preset thickness. The distal end of a six point 20 mm socket having a first band colored yellow having a width of half the preset thickness; adjoined to a second band colored black having a width of the preset thickness. The distal end of a six point 21 mm socket having a first band colored yellow having a width of half the preset thickness; adjoined to a second band colored white having a width of the preset thickness. The distal end of a six point 22 mm socket having a first band colored yellow having a width of half the preset thickness; adjoined to a second black line having a width one twentieth the preset thickness; adjoined to a third band colored yellow having a width of the preset thickness. The distal end of a six point 23 mm socket having a first band colored yellow having a width of half the preset thickness; adjoined to a second band colored green having a width of the preset thickness. The distal end of a six point 24 mm socket having a first band colored yellow having a width of half the preset thickness; adjoined to a second band colored light blue having a width of the preset thickness.

EXAMPLE 5

Metric Twelve-Point Socket Set

The distal end of a twelve point 4 mm socket having one band colored light blue having a width of half the preset thickness. The distal end of a twelve point 4.5 mm socket having a first band colored light blue having a width of half the preset thickness; adjoined to a second black band having a width one tenth the preset thickness; adjoined to third band colored orange having a width of one fourth the preset thickness. The distal end of a twelve point 5 mm socket having one band colored orange having a width of half the preset thickness. The distal end of a twelve point 5.5 mm socket having a first band colored orange having a width of half the preset thickness; adjoined to a second black band having a width one tenth the preset thickness; adjoined to third band colored orange having a width of one fourth the preset thickness. The distal end of a twelve point 6 mm socket having one band colored red having a width of half the preset thickness. The distal end of a twelve point 7 mm socket having one band colored gold having a width of half the preset thickness. The distal end of a twelve point 8 mm socket having one band colored purple having a width of half the preset thickness. The distal end of a twelve point 9 mm socket having one band colored dark blue having a width of half the preset thickness. The distal end of a twelve point 10 mm socket having a first band colored white having a width of half the preset thickness; adjoined to a second band colored black having a width of half the preset thickness. The distal end of a twelve point 11 mm socket having a first band colored white having a width of half the preset thickness; adjoined to a second black band one twentieth the preset thickness; adjoined to a third band colored white having a width of half the preset thickness. The distal end of a twelve point 12 mm socket having a first band colored white having a width of half the preset thickness; adjoined to a second band colored yellow having a width of half the preset thickness. The distal end of a twelve point 13 mm socket having a first band colored white having a width of half the preset thickness; adjoined to a second band colored green having a width of half the preset thickness.

The distal end of a twelve point 14 mm socket having a first band colored white having a width of half the preset thickness; adjoined to a second band colored light blue having a width of half the preset thickness. The distal end of a twelve point 15 mm socket having a first band colored white having a width of half the preset thickness; adjoined to a second band colored orange having a width of half the preset thickness. The distal end of a twelve point 16 mm socket having a first band colored white having a width of half the preset thickness; adjoined to a second band colored red having a width of half the preset thickness. The distal end of a twelve point 17 mm socket having a first band colored white having a width of half the preset thickness; adjoined to a second band colored gold having a width of half the preset thickness.

The distal end of a twelve point 18 mm socket having a first band colored white having a width of half the preset thickness; adjoined to a second band colored purple having a width of half the preset thickness. The distal end of a twelve point 19 mm socket having a first band colored white having a width of half the preset thickness; adjoined to a second band colored dark blue having a width of half the preset thickness. The distal end of a twelve point 20 mm socket having a first band colored yellow having a width of half the preset thickness; adjoined to a second band colored black having a width of half the preset thickness. The distal end of a twelve point 21 mm socket having a first band colored yellow having a width of half the preset thickness; adjoined to a second band colored white having a width of half the preset thickness.

The distal end of a twelve point 22 mm socket having a first band colored yellow having a width of half the preset thickness; adjoined to a second black line having a width one twentieth the preset thickness; adjoined to third band colored yellow having a width of half the preset thickness. The distal end of a twelve point 23 mm socket having a first band colored yellow having a width of half the preset thickness; adjoined to a second band colored green having a width of half the preset thickness. The distal end of a twelve point 24 mm socket having a first band colored yellow having a width of half the preset thickness; adjoined to a second band colored light blue having a width of half the preset thickness.

EXAMPLE 6

Standard Six-Point Box End Wrench Set

The distal end of a six point ¼ inch wrench having a first band colored white having a width of a set thickness; a space having a width of half of the set thickness; and a second band colored light blue having a width of half of the set thickness. The distal end of a six point 5/16 inch wrench having a first band colored orange having a width of the set thickness; a space having a width of half of the set thickness; a second band colored white having a width of half of the set thickness; adjoined to a third band colored red having a width of half of the set thickness. The distal end of a six point ⅜ inch wrench having a first band colored green having a width of the set thickness; a space having a width of half of the set thickness; and a second band colored purple having a width of half of the set thickness. The distal end of a six point 7/16 inch wrench having a first band colored gold having a width of the set thickness; a space having a width of half the set thickness; a second band colored white having a width of half of the set thickness; adjoined to a third band colored red having a width of half of the set thickness. The distal end of a six point ½ inch wrench having a first band colored white having a width of the set thickness; a space having a width of half of the set thickness; and a second band colored yellow having a width of half of the set thickness. The distal end of a six point 9/16 inch wrench having a first band colored dark blue having a width of the set thickness; a space having a width of half of the set thickness; a second band colored white having a width of half of the set thickness; adjoined to a third band colored red having a width of half of the set thickness. The distal end of a six point ⅝ inch wrench having a first band colored orange having a width of the set thickness; a space having a width of half of the set thickness; and a second band colored purple having a width of half of the set thickness. The distal end of a six point 11/16 inch wrench having a first band colored white having a width of half of the set thickness; adjoined to a black band having a width of one twentieth the set thickness; adjoined to a third band colored white having a width of the set thickness; a space having a width of half of the set thickness; a forth band colored white having a width of half of the set thickness; adjoined to a fifth band colored red having a width of half of the set thickness. The distal end of a six point ¾ inch wrench having a first band colored green having a width of the set thickness; a space having a width of half of the set thickness; and a second band colored light blue having a width of half of the set thickness. The distal end of a six point 13/16 inch wrench having a first band colored white having a width of half of the set thickness; adjoined to a second band colored green having a width of the set thickness; a space having a width of half of the set thickness; a third band colored white having a width of half of the set thickness; adjoined to a fourth band colored red having a width of half of the set thickness. The distal end of a six point ⅞ inch wrench having a first band colored gold having a width of the set thickness; a space having a width of half of the set thickness; and a second band colored purple having a width of half of the set thickness. The distal end of a six point 15/16 inch wrench having a first band colored white having a width of half of the set thickness; adjoined to a second band colored orange having a width of the set thickness; a space having a width of half of the set thickness; a third band colored white having a width of half of the set thickness; adjoined to a fourth band colored red having a width of half of the set thickness. The distal end of a six point, one inch, wrench having a first band colored black having a width one twentieth of the set thickness; adjoined to a second band colored white having the set thickness; adjoined to a third band colored black having a width one twentieth of the set thickness.

EXAMPLE 7

Standard Twelve-Point Box End Wrench Set

The distal end of a twelve point ¼ inch wrench having a first band colored white having a width of half of the set thickness; a space having a width of half of the set thickness; adjoined to a second band colored light blue having a width of half of the set thickness. The distal end of a twelve point 5/16 inch wrench having a first band colored orange having a width of half of the set thickness; a space having a width of half of the set thickness; a second band colored white having a width of half of the set thickness; adjoined to a third band colored red having a width of half of the set thickness. The distal end of a twelve point ⅜ inch wrench having a first band colored green having a width of half of the set thickness; a space having a width of half of the set thickness; and a second band colored purple having a width of half of the set thickness.

The distal end of a twelve point 7/16 inch wrench having a first band colored gold having a width of half of the set thickness; a space having a width of half of the set thickness; a second band colored white having a width of half of the set thickness; adjoined to a third band colored red having a width of half of the set thickness. The distal end of a twelve point ½ inch wrench having a first band colored white having a width of half of the set thickness; a space having a width of half of the set thickness; and a second band colored yellow having a width of half of the set thickness. The distal end of a twelve point 9/16 inch wrench having a first band colored dark blue having a width of half of the set thickness; a space having a width of half of the set thickness; a second band colored white having a width of half of the set thickness; adjoined to a third band colored red having a width of half of the set thickness. The distal end of a twelve point ⅝ inch wrench having a first band colored orange having a width of half of the set thickness; a space having a width of half of the set thickness; and a second band colored purple having a width of half of the set thickness. The distal end of a twelve point 11/16 inch wrench having a first band colored white having a width of half of the set thickness; adjoined to a black band one twentieth of the set thickness; adjoined to a third band colored white having a width of half of the set thickness; a space having half the set thickness; a forth band colored white having a width of half of the set thickness; adjoined to a fifth band colored red having a width of half of the set thickness. The distal end of a twelve point ¾ inch wrench having a first band colored green having a width of half of the set thickness; a space having a width of half of the set thickness; and a second band colored light blue having a width of half of the set thickness. The distal end of a twelve point 13/16 inch wrench having a first band colored white having a width of half of the set thickness; adjoined to a second band colored green having a width of half of the set thickness; a space having a width of half of the set thickness; a third band colored white having a width of half of the set thickness; adjoined to a fourth band colored red having a width of half of the set thickness. The distal end of a twelve point ⅞ inch wrench having a first band colored gold having a width of half of the set thickness; a space having a width of half of the set thickness; and a second band colored purple having a width of half of the set thickness. The distal end of a twelve point 15/16 inch wrench having a first band colored white having a width of half of the set thickness; adjoined to a second band colored orange having a width of half of the set thickness; a space having a width of half of the set thickness; a third band colored white having a width of half of the set thickness; adjoined to a fourth band colored red having a width of half of the set thickness. The distal end of a twelve point one inch wrench having a first band colored black having a width one twentieth of the set thickness; adjoined to a second band colored white having width one half the set thickness; adjoined to a third band colored black having a width one twentieth of the set thickness. The distal end of a twelve point one inch, Impact wrench having a first band colored red having a width one twentieth of the set thickness; adjoined to a second band colored white having width one half the set thickness; adjoined to a third band colored red having a width one twentieth of the set thickness.

EXAMPLE 8

Metric Six-Point Box End Wrench Set

The distal end of a six point metric wrench containing one digit will display single color-coded indicia having a width of the preset thickness, so as to indicate the six point feature. The distal end of a six point 4 mm wrench having one band colored light blue having a width of the preset thickness. The distal end of a six point 4.5 mm wrench having a first band colored light blue having a width of the preset thickness; adjoined to a second black band having a width one tenth the preset thickness; adjoined to third band colored orange having a width of one fourth the set thickness. The distal end of a six point 5 mm wrench having one band colored orange having a width of the preset thickness. The distal end of a six point 5.5 mm wrench having a first band colored orange having a width of the preset thickness; adjoined to a second black band having a width one tenth the preset thickness; adjoined to third band colored orange having a width of one fourth the preset thickness. The distal end of a six point 6 mm wrench having one band colored red having a width of the preset thickness. The distal end of a six point 7 mm wrench having one band colored gold having a width of the preset thickness. The distal end of a six point 8 mm wrench having one band colored purple having a width of the preset thickness The distal end of a six point 9 mm wrench having one band colored dark blue having a width of the preset thickness. The distal end of a six point 10 mm wrench having a first band colored white having a width of half the preset thickness; adjoined to a second band colored black having a width of the preset thickness. The distal end of a six point 11 mm wrench having a first band colored white having a width of half the preset thickness; adjoined to a second black band one twentieth the preset thickness; adjoined to a third band colored white having a width of the preset thickness. The distal end of a six point 12 mm wrench having a first band colored white having a width of half the preset thickness; adjoined to a second band colored yellow having a width of the preset thickness. The distal end of a six point 13 mm wrench having a first band colored white having a width of half the preset thickness; adjoined to a second band colored green having a width of the preset thickness. The distal end of a six point 14 mm wrench having a first band colored white having a width of half the preset thickness; adjoined to a second band colored light blue having a width of the preset thickness. The distal end of a six point 15 mm wrench having a first band colored white having a width of half the preset thickness; adjoined to a second band colored orange having a width of the preset thickness.

The distal end of a six point 16 mm wrench having a first band colored white having a width of half the preset thickness; adjoined to a second band colored red having a width of the preset thickness. The distal end of a six point 17 mm wrench having a first band colored white having a width of half the preset thickness; adjoined to a second band colored gold having a width of the preset thickness. The distal end of a six point 18 mm wrench having a first band colored white having a width of half the preset thickness; adjoined to a second band colored purple having a width of the preset thickness. The distal end of a six point 19 mm wrench having a first band colored white having a width of half the preset thickness; adjoined to a second band colored dark blue having a width of the preset thickness. The distal end of a six point 20 mm wrench having a first band colored yellow having a width of half the preset thickness; adjoined to a second band colored black having a width of the preset thickness. The distal end of a six point 21 mm wrench having a first band colored yellow having a width of half the preset thickness; adjoined to a second band colored white having a width of the preset thickness. The distal end of a six point 22 mm wrench having a first band colored yellow having a width of half the preset thickness; adjoined to a second black line having a width one twentieth the preset thickness; adjoined to a third band colored yellow having a width of the preset thickness. The distal end of a six point 23 mm wrench having a first band colored yellow having a width of half the preset thickness; adjoined to a second band colored green having a width of the preset thickness. The distal end of a six point 24 mm wrench having a first band colored yellow having a width of half the preset thickness; adjoined to a second band colored light blue having a width of the preset thickness.

EXAMPLE 9

Metric Twelve-Point Box End Wrench Set

The distal end of a twelve point 4 mm wrench having one band colored light blue having a width of half the preset thickness. The distal end of a twelve point 4.5 mm wrench having a first band colored light blue having a width of half the preset thickness; adjoined to a second black band having a width one tenth the preset thickness; adjoined to third band colored orange having a width of one fourth the preset thickness. The distal end of a twelve point 5 mm wrench having one band colored orange having a width of half the preset thickness. The distal end of a twelve point 5.5 mm wrench having a first band colored orange having a width of half the preset thickness; adjoined to a second black band having a width one tenth the preset thickness; adjoined to third band colored orange having a width of one fourth the preset thickness. The distal end of a twelve point 6 mm wrench having one band colored red having a width of half the preset thickness. The distal end of a twelve point 7 mm wrench having one band colored gold having a width of half the preset thickness The distal end of a twelve point 8 mm wrench having one band colored purple having a width of half the preset thickness. The distal end of a twelve point 9 mm wrench having one band colored dark blue having a width of half the preset thickness. The distal end of a twelve point 10 mm wrench having a first band colored white having a width of half the preset thickness; adjoined to a second band colored black having a width of half the preset thickness. The distal end of a twelve point 11 mm wrench having a first band colored white having a width of half the preset thickness; adjoined to a second black band one twentieth the preset thickness; adjoined to a third band colored white having a width of half the preset thickness. The distal end of a twelve point 12 mm wrench having a first band colored white having a width of half the preset thickness; adjoined to a second band colored yellow having a width of half the preset thickness. The distal end of a twelve point 13 mm wrench having a first band colored white having a width of half the preset thickness; adjoined to a second band colored green having a width of half the preset thickness.

The distal end of a twelve point 14 mm wrench having a first band colored white having a width of half the preset thickness; adjoined to a second band colored light blue having a width of half the preset thickness. The distal end of a twelve point 15 mm wrench having a first band colored white having a width of half the preset thickness; adjoined to a second band colored orange having a width of half the preset thickness. The distal end of a twelve point 16 mm wrench having a first band colored white having a width of half the preset thickness; adjoined to a second band colored red having a width of half the preset thickness. The distal end of a twelve point 17 mm wrench having a first band colored white having a width of half the preset thickness; adjoined to a second band colored gold having a width of half the preset thickness. The distal end of a twelve point 18 mm wrench having a first band colored white having a width of half the preset thickness; adjoined to a second band colored purple having a width of half the preset thickness. The distal end of a twelve point 19 mm wrench having a first band colored white having a width of half the preset thickness; adjoined to a second band colored dark blue having a width of half the preset thickness. The distal end of a twelve point 20 mm wrench having a first band colored yellow having a width of half the preset thickness; adjoined to a second band colored black having a width of half the preset thickness. The distal end of a twelve point 21 mm wrench having a first band colored yellow having a width of half the preset thickness; adjoined to a second band colored white having a width of half the preset thickness. The distal end of a twelve point 22 mm wrench having a first band colored yellow having a width of half the preset thickness; adjoined to a second black line having a width one twentieth the preset thickness; adjoined to third band colored yellow having a width of half the preset thickness. The distal end of a twelve point 23 mm wrench having a first band colored yellow having a width of half the preset thickness; adjoined to a second band colored green having a width of half the preset thickness. The distal end of a twelve point 24 mm wrench having a first band colored yellow having a width of half the preset thickness; adjoined to a second band colored light blue having a width of half the preset thickness.

EXAMPLE 10

Impact Socket

The one inch impact socket having a first band colored red having a width one twentieth of the set thickness; adjoined to a second band colored white having width of the set thickness; adjoined to a third band colored red having a width one twentieth of the set thickness.

EXAMPLE 11

Spline Box-End Wrench Set

The distal end of a spline box end wrench may optionally comprise of either or both bands of indicia as described herein, so as to indicate the spline configuration. The spline box end wrench may also optionally use the 12-point second color-coded indicia configuration, as well as, the first color-coded indicia which would combine the indicia as a space saving factor, so as, to indicate the specific numbers and size relevant to that particular spline box end wrench, as stated herein. The distal end of a number 8 spline ¼ inch box end wrench, has a first band colored purple has a width one fourth the set thickness; a space has a width of one fourth the set thickness; a second band colored white has a width of the set thickness; a space has a width of one half the set thickness; and a second band colored light blue has a width of the set thickness. The distal end of a number 10 spline 5/16 inch box end wrench has a first band colored white has a width one fourth the set thickness; adjoined to a second black band has a width of one fourth the set thickness; a space has a width of one fourth the set thickness; a third band colored orange has a width of the set thickness; a space has a width of half the set thickness; a fourth band colored white has a width of the set thickness; adjoined to a fifth band colored red has a width of the set thickness. The distal end of a number 12 spline ⅜ inch box end wrench has a first band colored white has a width one fourth the set thickness; adjoined to a second band colored yellow has a width of one fourth the set thickness; a space has a width of one fourth the set thickness; third band colored green has a width of the set thickness; a space has a width of half the set thickness; a fourth band colored purple has a width of the set thickness; adjoined to a fifth band colored red has a width of the set thickness. The distal end of a number 14 spline 7/16 inch box end wrench has a first band colored white has a width one fourth the set thickness; adjoined to a second band colored light blue has a width of one fourth the set thickness; a space has a width of one fourth the set thickness; a third gold band has a width of the set thickness; a space has a width of half the given thickness; a fourth band colored white has a width of the set thickness; adjoined to a fifth band colored red has a width of the set thickness. The distal end of a number 16 spline ½ inch box end wrench has a first band colored white has a width one fourth the set thickness; adjoined to a second band colored red has a width of one fourth the set thickness; a space has a width of one fourth the set thickness; a third band colored white has a width of the set thickness; a space has a width of half the set thickness; and a fourth band colored yellow has a width of the set thickness. The distal end of a number 18 spline 9/16 inch box end wrench has a first band colored white has a width one fourth the set thickness; adjoined to a second band colored purple has a width of one fourth the set thickness; a space has a width of one fourth the set thickness; a third band colored dark blue has a width of the set thickness; a space has a width of half the set thickness; a fourth band colored white has a width of the set thickness; adjoined to a fifth band colored red has a width of the set thickness. The distal end of a number 20 spline ⅝ inch box end wrench has a first band colored yellow has a width one fourth the set thickness; adjoined to a second band colored black has a width of one fourth the set thickness; a space has a width of one fourth the set thickness; third band colored orange has a width of the set thickness; a space has a width of half the set thickness; and a second band colored purple has a width of the set thickness. The distal end of a number 24 spline ¾ inch box end wrench has a first band colored yellow has a width one fourth the set thickness; adjoined to a second band colored light blue has a width of one fourth the set thickness; a space has a width of one fourth the set thickness; a third band colored green has a width of the set thickness; a space has a width of half the given thickness; and a fourth band colored light blue has a width of the set thickness. The distal end of a number 28 spline ⅞ inch box end wrench has a first band colored yellow has a width one fourth the set thickness; adjoined to a second band colored purple has a width of one fourth the set thickness; a space has a width of one fourth the set thickness; a third band colored gold has a width of the set thickness; a space has half the set thickness; and a fourth band colored purple has a width of the set thickness. The distal end of a number 22 spline 11/16 inch box end wrench has a first band colored yellow has a width one fourth the set thickness; adjoined to a second band colored black has a width of one twentieth the set thickness; adjoined to a third band colored yellow has a width of one fourth the set thickness; a space has a width of one fourth the set thickness; a fourth band colored white has a width of the set thickness; adjoined to a fifth band colored black has a width of one twentieth the set thickness; adjoined to a sixth band colored white has a width of the set thickness; a space has a width of half the given thickness; a seventh band colored white has a width of the set thickness; adjoined to a eighth band colored red has a width of the set thickness. The distal end of a number 26 spline 13/16 inch box end wrench has a first band colored yellow has a width one fourth the set thickness; adjoined to a second band colored red has a width of one fourth the set thickness; a space has a width of one fourth the set thickness; a third band colored white has a width of the set thickness; adjoined to a fourth band colored green has a width of the set thickness; a space has a width of half the given thickness; a fifth band colored white has a width of the set thickness; adjoined to a sixth band colored red has a width of the set thickness. The distal end of a number 30 spline 15/16 inch box end wrench has a first band colored green has a width one fourth the set thickness; adjoined to a second band colored black has a width of one fourth the set thickness; a space has a width of one fourth the set thickness; a third band colored white has a width of the set thickness; adjoined to a fourth band colored orange has a width of the set thickness; a space has a width of half the given thickness; a fifth band colored white has a width of the set thickness; adjoined to a sixth band colored red has a width of the set thickness.

EXAMPLE 12

Spline Socket Set

The distal end of a spline socket may optionally comprise of either or both bands of indicia as described herein, so as to indicate the spline configuration. The spline socket may also optionally use the 12-point second color-coded indicia, as well as the first color-coded indicia which would combine the indicia as a space saving factor so as to indicate the specific numbers and size relevant to that particular spline socket, as stated herein. The distal end of a number 8 spline ¼ inch socket, has a first band colored purple has a width one fourth the set thickness; a space has a width of one fourth the set thickness; a second band colored white has a width of the set thickness; a space has a width of one half the set thickness; and a second band colored light blue has a width of the set thickness. The distal end of a number 10 spline 5/16 inch socket has a first band colored white has a width one fourth the set thickness; adjoined to a second black band has a width of one fourth the set thickness; a space has a width of one fourth the set thickness; a third band colored orange has a width of the set thickness; a space has a width of half the set thickness; a fourth band colored white has a width of the set thickness; adjoined to a fifth band colored red has a width of the set thickness. The distal end of a number 12 spline 3/8 inch socket has a first band colored white has a width one fourth the set thickness; adjoined to a second band colored yellow has a width of one fourth the set thickness; a space has a width of one fourth the set thickness; third band colored green has a width of the set thickness; a space has a width of half the set thickness; a fourth band colored purple has a width of the set thickness; adjoined to a fifth band colored red has a width of the set thickness. The distal end of a number 14 spline 7/16 inch socket has a first band colored white has a width one fourth the set thickness; adjoined to a second band colored light blue has a width of one fourth the set thickness; a space has a width of one fourth the set thickness; a third gold band has a width of the set thickness; a space has a width of half the given thickness; a fourth band colored white has a width of the set thickness; adjoined to a fifth band colored red has a width of the set thickness. The distal end of a number 16 spline 1/2 inch socket has a first band colored white has a width one fourth the set thickness; adjoined to a second band colored red has a width of one fourth the set thickness; a space has a width of one fourth the set thickness; a third band colored white has a width of the set thickness; a space has a width of half the set thickness; and a fourth band colored yellow has a width of the set thickness. The distal end of a number 18 spline 9/16 inch socket has a first band colored white has a width one fourth the set thickness; adjoined to a second band colored purple has a width of one fourth the set thickness; a space has a width of one fourth the set thickness; a third band colored dark blue has a width of the set thickness; a space has a width of half the set thickness; a fourth band colored white has a width of the set thickness; adjoined to a fifth band colored red has a width of the set thickness. The distal end of a number 20 spline 5/8 inch socket has a first band colored yellow has a width one fourth the set thickness; adjoined to a second band colored black has a width of one fourth the set thickness; a space has a width of one fourth the set thickness; third band colored orange has a width of the set thickness; a space has a width of half the set thickness; and a second band colored purple has a width of the set thickness. The distal end of a number 24 spline 3/4 inch socket has a first band colored yellow has a width one fourth the set thickness; adjoined to a second band colored light blue has a width of one fourth the set thickness; a space has a width of one fourth the set thickness; a third band colored green has a width of the set thickness; a space has a width of half the given thickness; and a fourth band colored light blue has a width of the set thickness. The distal end of a number 28 spline 7/8 inch socket has a first band colored yellow has a width one fourth the set thickness; adjoined to a second band colored purple has a width of one fourth the set thickness; a space has a width of one fourth the set thickness; a third band colored gold has a width of the set thickness; a space has half the set thickness; and a fourth band colored purple has a width of the set thickness. The distal end of a number 22 spline 11/16 inch socket has a first band colored yellow has a width one fourth the set thickness; adjoined to a second band colored black has a width of one twentieth the set thickness; adjoined to a third band colored yellow has a width of one fourth the set thickness; a space has a width of one fourth the set thickness; a fourth band colored white has a width of the set thickness; adjoined to a fifth band colored black has a width of one twentieth the set thickness; adjoined to a sixth band colored white has a width of the set thickness; a space has a width of half the given thickness; a seventh band colored white has a width of the set thickness; adjoined to a eighth band colored red has a width of the set thickness. The distal end of a number 26 spline 13/16 inch socket has a first band colored yellow has a width one fourth the set thickness; adjoined to a second band colored red has a width of one fourth the set thickness; a space has a width of one fourth the set thickness; a third band colored white has a width of the set thickness; adjoined to a fourth band colored green has a width of the set thickness; a space has a width of half the given thickness; a fifth band colored white has a width of the set thickness; adjoined to a sixth band colored red has a width of the set thickness. The distal end of a number 30 spline 15/16 inch socket has a first band colored green has a width one fourth the set thickness; adjoined to a second band colored black has a width of one fourth the set thickness; a space has a width of one fourth the set thickness; a third band colored white has a width of the set thickness; adjoined to a fourth band colored orange has a width of the set thickness; a space has a width of half the given thickness; a fifth band colored white has a width of the set thickness; adjoined to a sixth band colored red has a width of the set thickness.

EXAMPLE 13

Standard-Open End Wrench

The recognizing means for recognizing the mouth gap of the open-end of each standard wrench of the standard wrench set comprises the following scheme. A 1/4 inch mouth gap of the open-end of each standard wrench has a first band colored white has a width of a given thickness; a space having a width of half the given thickness; and a second band having the given thickness colored light blue. A 5/16 inch mouth gap of the open-end of each standard wrench has a first band colored orange has a width of a given thickness; a space has a width of half the given thickness; a second band colored white has a width of a given thickness; a third band colored red has a width of a given thickness. A 3/8 inch mouth gap of the open-end of each standard wrench has a first band colored green has a width of a given thickness; a space has a width of half the given thickness; a second band colored purple has a width of a given thickness. A 7/16 inch mouth gap of the open-end of each standard wrench has a first band colored gold has a width of a given thickness; a space has a width of half the given thickness; a second band colored white has a width of a given thickness; a third band colored red has a width of a given thickness. A 1/2 inch mouth gap of the open-end of each standard wrench has a first band colored white has a width of a given thickness; a space has a width of half the given thickness; a second band colored yellow has a width of a given thickness. A 5/8 inch mouth gap of the open-end of each standard wrench has a first band colored orange has a width of a given thickness; a space has a width of half the given thickness; a second band colored purple has a width of a given thickness. A 3/4 inch mouth gap of the open-end of each standard wrench has a first band colored green has a width of a given thickness; a space has a width of half the given thickness; a second band colored light blue has a width of a given thickness. A 7/8 inch mouth gap of the open-end of each standard wrench has a first band colored gold has a width of a given thickness; a space has a width of half the given thickness; a second band colored purple has a width of a given thickness. A 9/16 inch mouth gap of the open-end of each standard wrench has a first band colored dark blue has a width of a given thickness; a space has a width of half the given thickness; a second band colored white has a width of a given thickness; a third band colored red has a width of a given thickness. A 11/16 inch mouth gap of the open-end of each standard wrench has a first band colored white has a width of a given thickness; a second black band one twentieth the given thickness and a third band colored white has a width of a given thickness; a space has a width of half the given thickness; a fourth band colored white has a width of a given thickness; and a fifth band colored red has a width of a given thickness. A 13/16 inch mouth gap of the open-end of each standard wrench has a first band colored white has a width of a given thickness; a second band colored green has a width of a given thickness; a space has a width of half the given thickness; a third band colored white has a width of a given thickness; a fourth band colored red has a width of a given thickness. A 15/16 inch mouth gap of the open-end of each standard wrench has a first band colored white has a width of a given thickness; a second band colored orange has a width of a given thickness; a space has a width of half the given thickness; a third band colored white has a width of a given thickness; a fourth band colored red has a width of a given thickness.

EXAMPLE 14

Metric Open-End Wrench

The recognizing means for recognizing the mouth gap of the open-end of each wrench of the metric wrench set comprises the following scheme. The 4 mm mouth gap of the open-end of each metric wrench has one band colored light blue has a width the preset thickness. The 4.5 mm mouth gap of the open-end of each metric wrench has a first band colored light blue has a width of the preset thickness; adjoined to a second band colored black has a width one tenth the preset thickness; adjoined to third band colored orange has a width of one fourth the set thickness. The 5 mm mouth gap of the open-end of each metric wrench has one band colored orange has a width of the preset thickness. The 5.5 mm mouth gap of the open-end of each metric wrench has a first band colored orange has a width of the preset thickness; adjoined to a second black band has a width one tenth the preset thickness; adjoined to third band colored orange has a width of one fourth the preset thickness. The 6 mm mouth gap of the open-end of each metric wrench has one band colored red has a width of the preset thickness. The 7 mm mouth gap of the open-end of each metric wrench has one band colored gold has a width of the preset thickness. The 8 mm mouth gap of the open-end of each metric wrench has one band colored purple has a width of the preset thickness. The 9 mm mouth gap of the open-end of each metric wrench has one band colored dark blue has a width of the preset thickness. A 10 mm mouth gap of the open-end of each metric wrench has a first band of set width colored white; adjoined to a second band of the identical set width colored black. An 11 mm mouth gap of the open end of each metric wrench has a first band of set width colored white; adjoined to a second black band one twentieth of the set width; adjoined to a third band of the identical set width colored white. A 12 mm mouth gap of the open-end of each metric wrench has a first band of set width colored white; adjoined to a second band of the identical set width colored yellow. A 13 mm mouth gap of the open-end of each metric wrench has a first band of set width colored white; adjoined to a second band of the identical set width colored green. A 14 mm mouth gap of the open-end of each metric wrench has a first band of set width colored white; adjoined to a second band of the identical set width colored light blue. A 15 mm mouth gap of the open-end of each metric wrench has a first band of set width colored white; adjoined to a second band of identical set width colored orange. A 16 mm mouth gap of the open-end of each metric wrench has a first band of set width colored white; adjoined to a second band of the identical set width colored red. A 17 mm mouth gap of the open-end of each metric wrench has a first band of set width colored white; adjoined to a second band of the identical set width colored gold. An 18 mm mouth gap of the open-end of each metric wrench has a first band of set width colored white; adjoined to a second band of the identical set width colored purple. A 19 mm mouth gap of the open-end of each metric wrench has a first band of set width colored white; adjoined to a second band of the identical set width colored dark blue. A 20 mm mouth gap of the open-end of each metric wrench has a first band of set width colored yellow; adjoined to a second band of the identical set width colored black. A 21 mm mouth gap of the open-end of each metric wrench has a first band of set width colored yellow; adjoined to a second band of the identical set width colored white. A 22 mm mouth gap of the open-end of each metric wrench has a first band of set width colored yellow; adjoined to a black line one twentieth the preset thickness; adjoined to a third band of the identical set width colored yellow.

EXAMPLE 15

Standard-Hexagonal Key Wrench

The denoting means affixed around each hexagonal key wrench of the hexagonal wrench set for denoting the diameter of each hexagonal wrench comprises the following scheme. A 1/4-inch diameter hexagonal key wrench having a first band of set width colored white; a space of half the set width; and a second band of half the set width colored light blue. A 5/16 inch diameter hexagonal key wrench having a first band of set width colored orange; a space of half the set width; a second band of half the set width colored white; adjoined to a third band of half the set width colored red. A 3/8 inch diameter hexagonal key wrench having a first band of set width colored green; a space of half the set width; and a second band of half the set width colored purple. A 7/16 inch diameter hexagonal key wrench having a first band of set width colored gold; a space of half the set width; a second band of half the set width colored white; and a third band of half the set width colored red. A 1/2 inch diameter hexagonal key wrench having a first band of set width colored white; a space of half the set width; and a second band of half the set width colored yellow. A 9/16 inch diameter hexagonal key wrench having a first band of set width colored dark blue; a space of half the set width; a second band of half the set width colored white; adjoined to a third band of half the set width colored red. A 5/8 inch diameter hexagonal key wrench having a first band of set width colored orange; a space of half the set width; and a second band of half the set width colored purple. A 3/4 inch diameter hexagonal key wrench having a first band of set width colored green; a space of half the set width; and a second band of half the set width colored light blue. A 7/8 inch diameter hexagonal key wrench having a first band of set width colored gold; a space of half the set width; and a second band of half the set width colored purple. A 11/16 inch diameter hexagonal key wrench having a first band of half the set width colored white; adjoined to a second black band one twentieth the set width; adjoined to a third band having the set width colored white; a space of half the set width; a fourth band of half the set width colored white; adjoined to a fifth band of half the set width colored red. A 13/16 inch diameter hexagonal key wrench having a first band of half the set width colored white adjoined to; a second band of the set width colored green; a space of half the set width; a third band of half the set width colored white; adjoined to a fourth band of half the set width colored red. A 15/16 inch diameter hexagonal key wrench having a first band of half the set width colored white; adjoined to a second band of the set width colored orange; a space of half the set width; a third band of half the set width colored white; adjoined to a fourth band of half the set width colored red.

EXAMPLE 16

Metric Hexagonal Key Wrench

The 4 mm diameter metric hexagonal key wrench having one band colored light blue having a width of the preset thickness. The 4.5 mm metric hexagonal key wrench has a first band colored light blue has a width of the preset thickness; adjoined to a second black band has a width one tenth the preset thickness; adjoined to third band colored orange has a width of one fourth the set thickness. The 5 mm metric hexagonal key wrench has one band colored orange has a width of the preset thickness. The 5.5 metric hexagonal key wrench has a first band colored orange having a width of the preset thickness; adjoined to a second black band has a width one tenth the preset thickness; adjoined to third band colored orange having a width of one fourth the preset thickness. The 6 mm metric hexagonal key wrench has one band colored red having a width of the preset thickness. The 7 mm metric hexagonal key wrench has one band colored gold having a width of the preset thickness. The 8 mm metric hexagonal key wrench has one band colored purple having a width of the preset thickness. The 9 mm metric hexagonal key wrench has one band colored dark blue having a width of the preset thickness. A 10 mm width hexagonal key wrench has a first band of half the set width colored white; adjoined to a second band of the set width colored black. An 11 mm width hexagonal key wrench has a first band of half the set width colored white; adjoined to a second band colored black has a width one twentieth of the set width: adjoined to a third band colored white has the set width. A 12 mm width hexagonal key wrench has a first band of half the set width colored white; adjoined to a second band of the set width colored yellow. A 13 mm width hexagonal key wrench has a first band of half the set width colored white; adjoined to a second band of the set width colored green. A 14 mm width hexagonal key wrench has a first band of half the set width colored white; adjoined to a second band of the set width colored light blue. A 15 mm width hexagonal key wrench has a first band of half the set width colored white; adjoined to a second band of the set width colored orange. A 16 mm width hexagonal key wrench has a first band of half the set width colored white; adjoined to a second band of the set width colored red.

EXAMPLE 17

Coarse Thread Standard Nut Set

The second color coded indicia is to be placed on the outer recessed perimeter of the nut sides. The recognizing means for recognizing the nut width, as well as, recognizing the coarse thread configuration of each nut, comprises the following scheme. A ¼ inch coarse thread nut has a first band colored white has a width of half the given thickness; a space has a width of half the given thickness; and a second band colored light blue has a width of half of the given thickness. A 5/16 inch coarse thread nut has a first band colored orange has a width of half the given thickness; a space has a width of half the set thickness; a second band colored white has a width of half of the given thickness; adjoined to a third band colored red has a width of half of the given thickness. A ⅜ inch coarse thread nut has a first band colored green has a width of half the given thickness; a space has a width of half the set thickness; and a second band colored purple has a width of half of the given thickness. A 7/16 inch coarse thread nut has a first band colored gold has a width of half the given thickness; a space has a width of half the given thickness; a second band colored white has a width of half of the given thickness; adjoined to a third band colored red has a width of half of the given thickness. A ½ inch coarse thread nut has a first band colored white has a width of half the given thickness; a space has a width of half the set thickness; and a second band colored yellow has a width of half of the given thickness. A 9/16 inch coarse thread nut has a first band colored dark blue has a width of half the given thickness; a space has a width of half the set thickness; a second band colored white has a width of half of the given thickness; adjoined to a third band colored red has a width of half of the given thickness. A ⅝ inch coarse thread nut has a first band colored orange has a width of half the given thickness; a space has a width of half the set thickness; and a second band colored purple has a width of half of the given thickness. A 11/16 inch coarse thread nut has a first band colored white has a width of half of the given thickness; adjoined to a second black band one twentieth the given thickness; adjoined to a third band colored white has a width of half the given thickness; a space has a width of half the given thickness; a third band colored white has a width of half the given thickness; adjoined to a fourth band colored red has a width of half of the given thickness. A ¾ inch coarse thread nut has a first band colored green has a width of half the given thickness; a space has a width of half the given thickness; and a second band colored light blue has a width of half of the given thickness. A 13/16 inch coarse thread nut has a first band colored white has a width of half of the given thickness; adjoined to a second band colored green has a width of half the given thickness; a space has a width of half the set thickness; a third band colored white has a width of half of the given thickness; adjoined to a fourth band colored red has a width of half of the given thickness. A ⅞ inch coarse thread nut has a first band colored gold has a width of half the given thickness; a space has a width of half the set thickness; and a second band colored purple has a width of half the given thickness. A 15/16 inch coarse thread nut has a first band colored white has a width of half of the given thickness; a second band colored orange has a width of half the given thickness; a space has a width of half the set thickness; a third band colored white has a width of half of the given thickness; and a fourth band colored red has a width of half of the given thickness. A one inch coarse thread nut has a first band colored black has a width of one twentieth the given thickness; adjoined to a white band has a width of half the given thickness; adjoined to a black band has one twentieth the given thickness.

EXAMPLE 18

Fine Thread Standard Nut Set

The second color coded indicia is be placed on the outer recessed perimeter of the nut sides. The recognizing means for recognizing the nut width, as well as, recognizing the fine thread configuration of each nut, comprises the following scheme. A fine thread ¼ inch nut has a first band colored white has a width of a given thickness; a space has a width of half the given thickness; and a second band colored light blue has a width of half of the given thickness. A fine thread 5/16 inch nut has a first band colored orange has a width of the given thickness; a space has a width of half the given thickness; a second band colored white has a width of half of the given thickness; and a third band colored red has a width of half of the given thickness. A fine thread ⅜ inch nut has a first band colored green has a width of the given thickness; a space has a width of half the given thickness; and a second band colored purple has a width of half of the given thickness. A fine thread 7/16 inch nut has a first band colored gold has a width of the given thickness; a space has a width of half the given thickness; a second band colored white has a width of half of the given thickness; and a third band colored red has a width of half of the given thickness. A fine thread ½ inch nut has a first band colored white has a width of the given thickness; a space has a width of half the given thickness; and a second band colored yellow has a width of half of the given thickness. A fine thread 9/16 inch nut has a first band colored dark blue has a width of the given thickness; a space; a second band colored white has a width of half of the given thickness; and a third band colored red has a width of half of the given thickness. A fine thread ⅝ inch nut has a first band colored orange has a width of the given thickness; a space has a width of half the given thickness; and a second band colored purple has a width of half of the given thickness. A fine thread ¾ inch nut has a first band colored green has a width of the given thickness; a space has a width of half the given thickness; and a second band colored light blue has a width of half of the given thickness. A fine thread 11/16 inch nut has a first band colored white has a width of half of the given thickness; adjoined to a second black band one twentieth the preset thickness; adjoined to a third band colored white has a width of the given thickness; a space has a width of half the given thickness; a forth band colored white has a width of half of the given thickness; adjoined to a fifth band colored red has a width of half of the given thickness. A fine thread ⅞ inch nut has a first band colored gold has a width of the given thickness; a space has a width of half the given thickness; and a second band colored purple has a width of half of the given thickness. A fine thread 13/16 inch nut has a first band colored white has a width of half of the given thickness; adjoined to a second band colored green has a width of the given thickness; a space has a width of half the given thickness; a third band colored white has a width of half of the given thickness; adjoined to a fourth band colored red has a width of half of the given thickness. A fine thread 15/16 inch nut has a first band colored white has a width of half of the given thickness; adjoined to a second band colored orange has a width of the given thickness; a space has a width of half the given thickness; a third band colored white has a width of half of the given thickness; adjoined to a fourth band colored red has a width of half of the given thickness.

EXAMPLE 19

Coarse Thread Metric Nut Set

The second color coded indicia is be placed on the outer recessed perimeter of the nut sides. The recognizing means for recognizing the nut width, as well as, recognizing the course thread configuration of each nut, comprises the following scheme. A 4 mm coarse thread nut has one band colored light blue has a width of half the preset thickness. A 4.5 mm coarse thread nut has a first band colored light blue has a width of half the preset thickness; adjoined to a second black band has a width one tenth the preset thickness; adjoined to third band colored orange has a width of one fourth the preset thickness. A 5 mm coarse thread nut has one band colored orange has a width of half the preset thickness. A 5.5 mm coarse thread nut has a first band colored orange has a width of half the preset thickness; adjoined to a second black band has a width one tenth the preset thickness; adjoined to third band colored orange has a width of fourth the preset thickness. A 6 mm coarse thread nut has one band colored red has a width of half the preset thickness. A 7 mm coarse thread nut has one band colored gold has a width of half the preset thickness. An 8 mm coarse thread nut has one band colored purple has a width of half the preset thickness. A 9 mm coarse thread nut has one band colored dark blue has a width of half the preset thickness. A 10 mm coarse thread nut has a first band colored white has a width of half a given thickness; adjoined to a second band colored black has a width of the identical half given thickness. An 11 mm coarse thread nut has a first band colored white has a width of half a given thickness; adjoined to a second black band one twentieth the given thickness; adjoined to a third band colored white has a width of the identical half given thickness. A 12 mm coarse thread nut has a first band colored white has a width of half a given thickness; adjoined to a second band colored yellow has a width of the identical half given thickness. A 13 mm coarse thread nut has a first band colored white has a width of half a given thickness; adjoined to a second band colored green has a width of the identical half given thickness. A 14 mm coarse thread nut has a first band colored white has a width of half a given thickness; adjoined to a second band colored light blue has a width of the identical half given thickness. A 15 mm coarse thread nut has a first band colored white has a width of half a given thickness; adjoined to a second band colored orange has a width of the identical half given thickness. A 16 mm coarse thread nut has a first band colored white has a width of a half given thickness; adjoined to a second band colored red has a width of the identical half given thickness. A 17 mm coarse thread nut has a first band colored white has a width of a half given thickness; adjoined to a second band colored gold has a width of the identical half given thickness. An 18 mm coarse thread nut has a first band colored white has a width of a half given thickness; adjoined to a second band colored purple has a width of the identical half given thickness. A 19 mm coarse thread nut has a first band colored white has a width of a half given thickness; adjoined to a second band colored dark blue has a width of the identical half given thickness. A 20 mm coarse thread nut has a first band colored yellow has a width of a half given thickness; adjoined to a second band colored black has a width of the identical half given thickness. A 21 mm coarse thread nut has a first band colored yellow has a width of a half given thickness; adjoined to a second band colored white has a width of the identical half given thickness. A 22 mm coarse thread nut has a first band colored yellow has a width of a half given thickness; adjoined to a second band colored black has a width one twentieth the set width; adjoined to a third band colored yellow has a width of the identical half given thickness.

EXAMPLE 20

Fine Thread Metric Nut Set

The second color coded indicia is be placed on the outer recessed perimeter of the nut sides. The recognizing means for recognizing the nut width, as well as, recognizing the fine thread configuration of each nut, comprises the following scheme. A 4 mm fine thread nut has one band colored light blue has a width of the preset thickness. A 4.5 mm fine thread nut has a first band colored light blue has a width of the preset thickness; adjoined to a second black band has a width one tenth the preset thickness; adjoined to third band colored orange has a width of one fourth the preset thickness. A 5 mm fine thread nut has one band colored orange has a width of the preset thickness. A 5.5 mm fine thread nut has a first band colored orange has a width of the preset thickness; adjoined to a second black band has a width one tenth the preset thickness; adjoined to third band colored orange has a width of fourth the preset thickness. A 6 mm fine thread nut has one band colored red has a width of the preset thickness. A 7 mm fine thread nut has one band colored gold has a width of the preset thickness. An 8 mm fine thread nut has one band colored purple has a width of the preset thickness. A 9 mm fine thread nut has one band colored dark blue has a width of the preset thickness. A fine thread 10 mm nut has a first band one half of the given width colored white; adjoined to a second band has a width of a given thickness colored black. A fine thread 11 mm nut has a first band one half of the given thickness colored white; adjoined to a second band has a width of one twentieth the given thickness colored black; adjoined to a third band has a width of given thickness colored white A fine thread 12 mm nut has a first band one half of the given width colored white; adjoined to a second band has a width of a given thickness colored yellow. A fine thread 13 mm nut has a first band one half of the given width colored white; adjoined to second band has a width of a given thickness colored green. A fine thread 14 mm nut has a first band one half of the given width colored white; adjoined to second band has a width of a given thickness colored light blue. A fine thread 15 mm nut has a first band one half of the given width colored white; adjoined to second band has a width of a given thickness colored orange. A fine thread 16 mm nut has a first band one half of the given width colored white; adjoined to second band has a width of a given thickness colored red. A fine thread 17 mm nut has a first band one half of the given width colored white; adjoined to second band has a width of a given thickness colored gold. A fine thread 18 mm nut has a first band one half of the given width colored white; adjoined to a second band has a width of a given thickness colored purple. A fine thread 19 mm nut has a first band one half of the given width colored white; adjoined to a second band has a width of a given thickness colored blue. A fine thread 20 mm nut has a first band one half of the given width colored yellow; adjoined to a second band has a width of a given thickness colored black. A fine thread 21 mm nut has a first band one half of the given width colored yellow; adjoined to second band has a width of a given thickness colored white. A fine thread 22 mm nut has a first band one half of the given width colored yellow; adjoined to second band has a width one twentieth the given thickness: adjoined to a third band of a given thickness colored yellow.

EXAMPLE 21

Coarse Thread Standard Bolt Set

The second color coded indicia is optionally placed on the outer recessed perimeter of a bolt, or in a circular recessed arrangement on the top face of the bolt head. The recognizing means for recognizing the bolt head width, as well as, recognizing the coarse thread configuration of each bolt comprises the following scheme. A ¼ inch coarse thread bolt has a first band colored white has a width of half the given thickness; a space has a width of half the given thickness; and a second band colored light blue has a width of half of the given thickness. A 5/16 inch coarse thread bolt has a first band colored orange has a width of half the given thickness; a space has a width of half the set thickness; a second band colored white has a width of half of the given thickness; adjoined to a third band colored red has a width of half of the given thickness. A ⅜ inch coarse thread bolt has a first band colored green has a width of half the given thickness; a space has a width of half the set thickness; and a second band colored purple has a width of half of the given thickness. A 7/16 inch coarse thread bolt has a first band colored gold has a width of half the given thickness; a space has a width of half the given thickness; a second band colored white has a width of half of the given thickness; adjoined to a third band colored red has a width of half of the given thickness. A ½ inch coarse thread bolt has a first band colored white has a width of half the given thickness; a space has a width of half the set thickness; and a second band colored yellow has a width of half of the given thickness. A 9/16 inch coarse thread bolt has a first band colored dark blue has a width of half the given thickness; a space has a width of half the set thickness; a second band colored white has a width of half of the given thickness; adjoined to a third band colored red has a width of half of the given thickness. A ⅝ inch coarse thread bolt has a first band colored orange has a width of half the given thickness; a space has a width of half the set thickness; and a second band colored purple has a width of half of the given thickness. A 11/16 inch coarse thread bolt has a first band colored white has a width of half of the given thickness; adjoined to a second black band one twentieth the given thickness; adjoined to a third band colored white has a width of half the given thickness; a space has a width of half the given thickness; a third band colored white has a width of half the given thickness; adjoined to a fourth band colored red has a width of half of the given thickness. A ¾ inch coarse thread bolt has a first band colored green has a width of half the given thickness; a space has a width of half the given thickness; and a second band colored light blue has a width of half of the given thickness. A 13/16 inch coarse thread bolt has a first band colored white has a width of half of the given thickness; adjoined to a second band colored green has a width of half the given thickness; a space has a width of half the set thickness; a third band colored white has a width of half of the given thickness; adjoined to a fourth band colored red has a width of half of the given thickness. A ⅞ inch coarse thread bolt has a first band colored gold has a width of half the given thickness; a space has a width of half the set thickness; and a second band colored purple has a width of half the given thickness. A 15/16 inch coarse thread bolt has a first band colored white has a width of half of the given thickness; a second band colored orange has a width of half the given thickness; a space has a width of half the set thickness; a third band colored white has a width of half of the given thickness; and a fourth band colored red has a width of half of the given thickness. A one inch coarse thread bolt has a first band colored black has a width of one twentieth the given thickness; adjoined to a white band has a width of half the given thickness; adjoined to a black band has one twentieth the given thickness.

EXAMPLE 22

Fine Thread Standard Bolt Set

The second color coded indicia is optionally placed on the outer recessed perimeter of a bolt, or in a circular recessed arrangement on the top face of the bolt head. The recognizing means for recognizing the bolt head width, as well as, recognizing the fine thread configuration of each bolt comprises the following scheme. A fine thread ¼ inch bolt has a first band colored white has a width of a given thickness; a space has a width of half the given thickness; and a second band colored light blue has a width of half of the given thickness. A fine thread 5/16 inch bolt has a first band colored orange has a width of the given thickness; a space has a width of half the given thickness; a second band colored white has a width of half of the given thickness; and a third band colored red has a width of half of the given thickness. A fine thread ⅜ inch bolt has a first band colored green has a width of the given thickness; a space has a width of half the given thickness; and a second band colored purple has a width of half of the given thickness. A fine thread 7/16 inch bolt has a first band colored gold has a width of the given thickness; a space has a width of half the given thickness; a second band colored white has a width of half of the given thickness; and a third band colored red has a width of half of the given thickness. A fine thread ½ inch bolt has a first band colored white has a width of the given thickness; a space has a width of half the given thickness; and a second band colored yellow has a width of half of the given thickness. A fine thread 9/16 inch bolt has a first band colored dark blue has a width of the given thickness; a space; a second band colored white has a width of half of the given thickness; and a third band colored red has a width of half of the given thickness. A fine thread ⅝ inch bolt has a first band colored orange has a width of the given thickness; a space has a width of half the given thickness; and a second band colored purple has a width of half of the given thickness. A fine thread ¾ inch bolt has a first band colored green has a width of the given thickness; a space has a width of half the given thickness; and a second band colored light blue has a width of half of the given thickness. A fine thread 11/16 inch bolt has a first band colored white has a width of half of the given thickness; adjoined to a second black band one twentieth the preset thickness; adjoined to a third band colored white has a width of the given thickness; a space has a width of half the given thickness; a forth band colored white has a width of half of the given thickness; adjoined to a fifth band colored red has a width of half of the given thickness. A fine thread ⅞ inch bolt has a first band colored gold has a width of the given thickness; a space has a width of half the given thickness; and a second band colored purple has a width of half of the given thickness. A fine thread 13/16 inch bolt has a first band colored white has a width of half of the given thickness; adjoined to a second band colored green has a width of the given thickness; a space has a width of half the given thickness; a third band colored white has a width of half of the given thickness; adjoined to a fourth band colored red has a width of half of the given thickness. A fine thread 15/16 inch bolt has a first band colored white has a width of half of the given thickness; adjoined to a second band colored orange has a width of the given thickness; a space has a width of half the given thickness; a third band colored white has a width of half of the given thickness; adjoined to a fourth band colored red has a width of half of the given thickness.

EXAMPLE 23

Coarse Thread Metric Bolt Set

The second color coded indicia is optionally placed on the outer recessed perimeter of a bolt, or in a circular recessed arrangement on the top face of the bolt head. The recognizing means for recognizing the bolt, as well as, recognizing the coarse thread configuration of each bolt comprises the following scheme. A 4 mm coarse thread bolt has one band colored light blue has a width of half the preset thickness. A 4.5 mm coarse thread bolt has a first band colored light blue has a width of half the preset thickness; adjoined to a second black band has a width one tenth the preset thickness; adjoined to third band colored orange has a width of one fourth the preset thickness. A 5 mm coarse thread bolt has one band colored orange has a width of half the preset thickness. A 5.5 mm coarse thread bolt has a first band colored orange has a width of half the preset thickness; adjoined to a second black band has a width one tenth the preset thickness; adjoined to third band colored orange has a width of fourth the preset thickness. A 6 mm coarse thread bolt has one band colored red has a width of half the preset thickness. A 7 mm coarse thread bolt has one band colored gold has a width of half the preset thickness. An 8 mm coarse thread bolt has one band colored purple has a width of half the preset thickness. A 9 mm coarse thread bolt has one band colored dark blue has a width of half the preset thickness. A 10 mm coarse thread bolt has a first band colored white has a width of half a given thickness; adjoined to a second band colored black has a width of the identical half given thickness. An 11 mm coarse thread bolt has a first band colored white has a width of half a given thickness; adjoined to a second black band one twentieth the given thickness; adjoined to a third band colored white has a width of the identical half given thickness. A 12 mm coarse thread bolt has a first band colored white has a width of half a given thickness; adjoined to a second band colored yellow has a width of the identical half given thickness. A 13 mm coarse thread bolt has a first band colored white has a width of half a given thickness; adjoined to a second band colored green has a width of the identical half given thickness. A 14 mm coarse thread bolt has a first band colored white has a width of half a given thickness; adjoined to a second band colored light blue has a width of the identical half given thickness. A 15 mm coarse thread bolt has a first band colored white has a width of half a given thickness; adjoined to a second band colored orange has a width of the identical half given thickness. A 16 mm coarse thread bolt has a first band colored white has a width of a half given thickness; adjoined to a second band colored red has a width of the identical half given thickness. A 17 mm coarse thread bolt has a first band colored white has a width of a half given thickness; adjoined to a second band colored gold has a width of the identical half given thickness. An 18 mm coarse thread bolt has a first band colored white has a width of a half given thickness; adjoined to a second band colored purple has a width of the identical half given thickness. A 19 mm coarse thread bolt has a first band colored white has a width of a half given thickness; adjoined to a second band colored dark blue has a width of the identical half given thickness. A 20 mm coarse thread bolt has a first band colored yellow has a width of a half given thickness; adjoined to a second band colored black has a width of the identical half given thickness. A 21 mm coarse thread bolt has a first band colored yellow has a width of a half given thickness; adjoined to a second band colored white has a width of the identical half given thickness. A 22 mm coarse thread bolt has a first band colored yellow has a width of a half given thickness; adjoined to a second band colored black has a width one twentieth the set width; adjoined to a third band colored yellow has a width of the identical half given thickness.

EXAMPLE 24

Fine Thread Metric Bolt Set

The second color coded indicia is optionally placed on the outer recessed perimeter of a bolt, or in a circular recessed arrangement on the top face of the bolt head. The recognizing means for recognizing the bolt head width, as well as, recognizing the fine thread configuration of each bolt comprises the following scheme. A 4 mm fine thread bolt has one band colored light blue has a width of the preset thickness. A 4.5 mm fine thread bolt has a first band colored light blue has a width of the preset thickness; adjoined to a second black band has a width one tenth the preset thickness; adjoined to third band colored orange has a width of one fourth the preset thickness. A 5 mm fine thread bolt has one band colored orange has a width of the preset thickness. A 5.5 mm fine thread bolt has a first band colored orange has a width of the preset thickness; adjoined to a second black band has a width one tenth the preset thickness; adjoined to third band colored orange has a width of fourth the preset thickness. A 6 mm fine thread bolt has one band colored red has a width of the preset thickness. A 7 mm fine thread bolt has one band colored gold has a width of the preset thickness. An 8 mm fine thread bolt has one band colored purple has a width of the preset thickness. A 9 mm fine thread bolt has one band colored dark blue has a width of the preset thickness. A fine thread 10 mm bolt has a first band one half of the given width colored white; adjoined to a second band has a width of a given thickness colored black. A fine thread 11 mm bolt has a first band one half of the given thickness colored white; adjoined to a second band has a width of one twentieth the given thickness colored black; adjoined to a third band has a width of given thickness colored white A fine thread 12 mm bolt has a first band one half of the given width colored white; adjoined to a second band has a width of a given thickness colored yellow. A fine thread 13 mm bolt has a first band one half of the given width colored white; adjoined to second band has a width of a given thickness colored green. A fine thread 14 mm bolt has a first band one half of the given width colored white; adjoined to second band has a width of a given thickness colored light blue. A fine thread 15 mm bolt has a first band one half of the given width colored white; adjoined to second band has a width of a given thickness colored orange. A fine thread 16 mm bolt has a first band one half of the given width colored white; adjoined to second band has a width of a given thickness colored red. A fine thread 17 mm bolt has a first band one half of the given width colored white; adjoined to second band has a width of a given thickness colored gold. A fine thread 18 mm bolt has a first band one half of the given width colored white; adjoined to a second band has a width of a given thickness colored purple. A fine thread 19 mm bolt has a first band one half of the given width colored white; adjoined to a second band has a width of a given thickness colored blue. A fine thread 20 mm bolt has a first band one half of the given width colored yellow; adjoined to a second band has a width of a given thickness colored black. A fine thread 21 mm bolt has a first band one half of the given width colored yellow; adjoined to second band has a width of a given thickness colored white. A fine thread 22 mm bolt has a first band one half of the given width colored yellow; adjoined to second band has a width one twentieth the given thickness: adjoined to a third band of a given thickness colored yellow.

EXAMPLE 25

Coarse Thread Standard Hexagonal Screw Set

The second color coded indicia is placed to the upper cylindrical area of the hexagonal screw. The recognizing means for recognizing the hexagonal screw width, as well as, recognizing the coarse thread configuration of each hexagonal screw comprises the following scheme. A ¼ inch coarse thread hexagonal screw has a first band colored white has a width of half the given thickness; a space has a width of half the given thickness; and a second band colored light blue has a width of half of the given thickness. A 5/16 inch coarse thread hexagonal screw has a first band colored orange has a width of half the given thickness; a space has a width of half the set thickness; a second band colored white has a width of half of the given thickness; adjoined to a third band colored red has a width of half of the given thickness. A ⅜ inch coarse thread hexagonal screw has a first band colored green has a width of half the given thickness; a space has a width of half the set thickness; and a second band colored purple has a width of half of the given thickness. A 7/16 inch coarse thread hexagonal screw has a first band colored gold has a width of half the given thickness; a space has a width of half the given thickness; a second band colored white has a width of half of the given thickness; adjoined to a third band colored red has a width of half of the given thickness. A ½ inch coarse thread hexagonal screw has a first band colored white has a width of half the given thickness; a space has a width of half the set thickness; and a second band colored yellow has a width of half of the given thickness. A 9/16 inch coarse thread hexagonal screw has a first band colored dark blue has a width of half the given thickness; a space has a width of half the set thickness; a second band colored white has a width of half of the given thickness; adjoined to a third band colored red has a width of half of the given thickness. A ⅝ inch coarse thread hexagonal screw has a first band colored orange has a width of half the given thickness; a space has a width of half the set thickness; and a second band colored purple has a width of half of the given thickness. A 11/16 inch coarse thread hexagonal screw has a first band colored white has a width of half of the given thickness; adjoined to a second black band one twentieth the given thickness; adjoined to a third band colored white has a width of half the given thickness; a space has a width of half the given thickness; a third band colored white has a width of half the given thickness; adjoined to a fourth band colored red has a width of half of the given thickness. A ¾ inch coarse thread hexagonal screw has a first band colored green has a width of half the given thickness; a space has a width of half the given thickness; and a second band colored light blue has a width of half of the given thickness. A 13/16 inch coarse thread hexagonal screw has a first band colored white has a width of half of the given thickness; adjoined to a second band colored green has a width of half the given thickness; a space has a width of half the set thickness; a third band colored white has a width of half of the given thickness; adjoined to a fourth band colored red has a width of half of the given thickness. A 7/8 inch coarse thread hexagonal screw has a first band colored gold has a width of half the given thickness; a space has a width of half the set thickness; and a second band colored purple has a width of half the given thickness. A 15/16 inch coarse thread hexagonal screw has a first band colored white has a width of half of the given thickness; a second band colored orange has a width of half the given thickness; a space has a width of half the set thickness; a third band colored white has a width of half of the given thickness; and a fourth band colored red has a width of half of the given thickness. A one inch coarse thread hexagonal screw has a first band colored black has a width of one twentieth the given thickness; adjoined to a white band has a width of half the given thickness; adjoined to a black band has one twentieth the given thickness.

EXAMPLE 26

Fine Thread Standard Hexagonal Screw Set

The second color coded indicia is placed to the upper cylindrical area of the hexagonal screw. The recognizing means for recognizing the hexagonal screw hole width, as well as, recognizing the fine thread configuration of each hexagonal screw comprises the following scheme. A fine thread 1/4 inch hexagonal screw has a first band colored white has a width of a given thickness; a space has a width of half the given thickness; and a second band colored light blue has a width of half of the given thickness A fine thread 5/16 inch hexagonal screw has a first band colored orange has a width of the given thickness; a space has a width of half the given thickness; a second band colored white has a width of half of the given thickness; and a third band colored red has a width of half of the given thickness. A fine thread 3/8 inch hexagonal screw has a first band colored green has a width of the given thickness; a space has a width of half the given thickness; and a second band colored purple has a width of half of the given thickness. A fine thread 7/16 inch hexagonal screw has a first band colored gold has a width of the given thickness; a space has a width of half the given thickness; a second band colored white has a width of half of the given thickness; and a third band colored red has a width of half of the given thickness. A fine thread 1/2 inch hexagonal screw has a first band colored white has a width of the given thickness; a space has a width of half the given thickness; and a second band colored yellow has a width of half of the given thickness. A fine thread 9/16 inch hexagonal screw has a first band colored dark blue has a width of the given thickness; a space; a second band colored white has a width of half of the given thickness; and a third band colored red has a width of half of the given thickness. A fine thread 5/8 inch hexagonal screw has a first band colored orange has a width of the given thickness; a space has a width of half the given thickness; and a second band colored purple has a width of half of the given thickness. A fine thread 3/4 inch hexagonal screw has a first band colored green has a width of the given thickness; a space has a width of half the given thickness; and a second band colored light blue has a width of half of the given thickness. A fine thread 11/16 inch hexagonal screw has a first band colored white has a width of half of the given thickness; adjoined to a second black band one twentieth the preset thickness; adjoined to a third band colored white has a width of the given thickness; a space has a width of half the given thickness; a forth band colored white has a width of half of the given thickness; adjoined to a fifth band colored red has a width of half of the given thickness. A fine thread 7/8 inch hexagonal screw has a first band colored gold has a width of the given thickness; a space has a width of half the given thickness; and a second band colored purple has a width of half of the given thickness. A fine thread 13/16 inch hexagonal screw has a first band colored white has a width of half of the given thickness; adjoined to a second band colored green has a width of the given thickness; a space has a width of half the given thickness; a third band colored white has a width of half of the given thickness; adjoined to a fourth band colored red has a width of half of the given thickness. A fine thread 15/16 inch hexagonal screw has a first band colored white has a width of half of the given thickness; adjoined to a second band colored orange has a width of the given thickness; a space has a width of half the given thickness; a third band colored white has a width of half of the given thickness; adjoined to a fourth band colored red has a width of half of the given thickness.

EXAMPLE 27

Coarse Thread Metric Hexagonal Screw Set

The second color coded indicia is placed to the upper cylindrical area of the hexagonal screw. The recognizing means for recognizing the hexagonal screw hole width, as well as, recognizing the coarse thread configuration of each hexagonal screw comprises the following scheme. A 4 mm coarse thread hexagonal screw has one band colored light blue has a width of half the preset thickness. A 4.5 mm coarse thread hexagonal screw has a first band colored light blue has a width of half the preset thickness; adjoined to a second black band has a width one tenth the preset thickness; adjoined to third band colored orange has a width of one fourth the preset thickness. A 5 mm coarse thread hexagonal screw has one band colored orange has a width of half the preset thickness. A 5.5 mm coarse thread hexagonal screw has a first band colored orange has a width of half the preset thickness; adjoined to a second black band has a width one tenth the preset thickness; adjoined to third band colored orange has a width of fourth the preset thickness. A 6 mm coarse thread hexagonal screw has one band colored red has a width of half the preset thickness. A 7 mm coarse thread hexagonal screw has one band colored gold has a width of half the preset thickness. An 8 mm coarse thread hexagonal screw has one band colored purple has a width of half the preset thickness. A 9 mm coarse thread hexagonal screw has one band colored dark blue has a width of half the preset thickness. A 10 mm coarse thread hexagonal screw has a first band colored white has a width of half a given thickness; adjoined to a second band colored black has a width of the identical half given thickness. An 11 mm coarse thread hexagonal screw has a first band colored white has a width of half a given thickness; adjoined to a second black band one twentieth the given thickness; adjoined to a third band colored white has a width of the identical half given thickness. A 12 mm coarse thread hexagonal screw has a first band colored white has a width of half a given thickness; adjoined to a second band colored yellow has a width of the identical half given thickness. A 13 mm coarse thread hexagonal screw has a first band colored white has a width of half a given thickness; adjoined to a second band colored green has a width of the identical half given thickness. A 14 mm coarse thread hexagonal screw has a first band colored white has a width of half a given thickness; adjoined to a second band colored light blue has a width of the identical half given thickness. A 15 mm coarse thread hexagonal screw has a first band colored white has a width of half a given thickness; adjoined to a second band colored orange has a width of the identical half given thickness. A 16 mm coarse thread hexagonal screw has a first band colored white has a width of a half given thickness; adjoined to a second band colored red has a width of the identical half given thickness. A 17 mm coarse thread hexagonal screw has a first band colored white has a width of a half given thickness; adjoined to a second band colored gold has a width of the identical half given thickness. An 18 mm coarse thread hexagonal screw has a first band colored white has a width of a half given thickness; adjoined to a second band colored purple has a width of the identical half given thickness. A 19 mm coarse thread hexagonal screw has a first band colored white has a width of a half given thickness; adjoined to a second band colored dark blue has a width of the identical half given thickness. A 20 mm coarse thread hexagonal screw has a first band colored yellow has a width of a half given thickness; adjoined to a second band colored black has a width of the identical half given thickness. A 21 mm coarse thread hexagonal screw has a first band colored yellow has a width of a half given thickness; adjoined to a second band colored white has a width of the identical half given thickness. A 22 mm coarse thread hexagonal screw has a first band colored yellow has a width of a half given thickness; adjoined to a second band colored black has a width one twentieth the set width; adjoined to a third band colored yellow has a width of the identical half given thickness.

EXAMPLE 28

Fine Thread Metric Hexagonal Screw Set

The second color coded indicia is placed to the upper cylindrical area of the hexagonal screw. The recognizing means for recognizing the hexagonal screw hole width, as well as, recognizing the fine thread configuration of each hexagonal screw comprises the following scheme. A 4 mm fine thread hexagonal screw has one band colored light blue has a width of the preset thickness. A 4.5 mm fine thread hexagonal screw has a first band colored light blue has a width of the preset thickness; adjoined to a second black band has a width one tenth the preset thickness; adjoined to third band colored orange has a width of one fourth the preset thickness. A 5 mm fine thread hexagonal screw has one band colored orange has a width of the preset thickness. A 5.5 mm fine thread hexagonal screw has a first band colored orange has a width of the preset thickness; adjoined to a second black band has a width one tenth the preset thickness; adjoined to third band colored orange has a width of fourth the preset thickness. A 6 mm fine thread hexagonal screw has one band colored red has a width of the preset thickness. A 7 mm fine thread hexagonal screw has one band colored gold has a width of the preset thickness. An 8 mm fine thread hexagonal screw has one band colored purple has a width of the preset thickness. A 9 mm fine thread hexagonal screw has one band colored dark blue has a width of the preset thickness. A fine thread 10 mm hexagonal screw has a first band one half of the given width colored white; adjoined to a second band has a width of a given thickness colored black. A fine thread 11 mm hexagonal screw has a first band one half of the given thickness colored white; adjoined to a second band has a width of one twentieth the given thickness colored black; adjoined to a third band has a width of given thickness colored white A fine thread 12 mm hexagonal screw has a first band one half of the given width colored white; adjoined to a second band has a width of a given thickness colored yellow. A fine thread 13 mm hexagonal screw has a first band one half of the given width colored white; adjoined to second band has a width of a given thickness colored green. A fine thread 14 mm hexagonal screw has a first band one half of the given width colored white; adjoined to second band has a width of a given thickness colored light blue. A fine thread 15 mm hexagonal screw has a first band one half of the given width colored white; adjoined to second band has a width of a given thickness colored orange. A fine thread 16 mm hexagonal screw has a first band one half of the given width colored white; adjoined to second band has a width of a given thickness colored red. A fine thread 17 mm hexagonal screw has a first band one half of the given width colored white; adjoined to second band has a width of a given thickness colored gold. A fine thread 18 mm hexagonal screw has a first band one half of the given width colored white; adjoined to a second band has a width of a given thickness colored purple. A fine thread 19 mm hexagonal screw has a first band one half of the given width colored white; adjoined to a second band has a width of a given thickness colored blue. A fine thread 20 mm hexagonal screw has a first band one half of the given width colored yellow; adjoined to a second band has a width of a given thickness colored black. A fine thread 21 mm hexagonal screw has a first band one half of the given width colored yellow; adjoined to second band has a width of a given thickness colored white. A fine thread 22 mm hexagonal screw has a first band one half of the given width colored yellow; adjoined to second band has a width one twentieth the given thickness: adjoined to a third band of a given thickness colored yellow.

EXAMPLE 29

Fine Thread Standard Tap and Die Set

A tap, of the tap and die set, has the second color coded indicia applied to the upper shaft of the tap, so as to display the appropriate size diameter of that particular tap, as well as, a set varied width of the second color coded indicia to indicate the fine thread feature of that particular tap. A die from the tap and die set, has the second color coded indicia applied in a circular arrangement to the upper face or the cylindrical side of the die from the tap and die set, so as to indicate the appropriate diameter of the hole size of that particular die, as well as, using a set varied width of the second color coded indicia to indicate the fine thread feature of that particular die.

The first color coded indicia will be recessed and applied to the lower shaft portion of a tap from the tap and die set, so as to indicate the precise thread count of that particular tap, as well as, the first color coded indicia being recessed and applied in a circular arrangement upon the face or the cylindrical side of the die, so as to indicate the appropriate thread count of that particular die. The recognizing means for recognizing the tap or die width, as well as, recognizing the fine thread configuration of each tap or die comprises the following scheme.

A fine thread ¼ inch, tap and die, has a first band colored white having a width of the given thickness; a space has a width of half the given thickness; and a second band colored light blue has a width of half the given thickness. A fine thread ⅜ inch tap and die has a first band colored green having a width of the given thickness; a space has a width of half the given thickness; and a second band colored purple has a width of half the given thickness. A fine thread ½ inch tap and die has a first band colored white having a width of the given thickness; a space has a width of half the given thickness; and a second band colored yellow has a width of half the given thickness. A fine thread ⅝ inch tap and die has a first band colored orange has a width of the given thickness; a space has a width of half the given thickness; and a second band colored purple has a width of half the given thickness. A fine thread ¾ inch tap and die has a first band colored green having a width of the given thickness; a space has a width of half the given thickness; and a second band colored light blue having a width of half the given thickness. A fine thread ⅞ inch tap and die has a first band colored gold having a width of the given thickness; a space has a width of half the given thickness; and a second band colored purple has a width of half the given thickness. A fine thread 5/16 inch tap and die has a first band colored orange having a width of the given thickness; a space has a width of half the given thickness; a second band colored white has a width of half the given thickness; and a third band colored red has a width of half the given thickness. A fine thread 7/16 inch head has a first band colored gold having a width of the given thickness; a space has a width of half the given thickness; a second band colored white has a width of half the given thickness; and a third band colored red has a width of half the given thickness. A fine thread 9/16 inch tap and die has a first band colored dark blue having a width of the given thickness; a space has a width of half the given thickness; a second band colored white has a width of half the given thickness; and a third band colored red has a width of half the given thickness. A fine thread 11/16 inch tap and die has a first band colored white having a width of half the given thickness; adjoined to a second band colored black has a width one twentieth the given thickness; adjoined to a third band colored white has a width of the given thickness; a space has a width of half the given thickness; a fourth band colored white has a width of half the given thickness; and a fifth band colored red has a width of half the given thickness. A fine thread 13/16 inch tap and die has a first band colored white having a width of half the given thickness; a second band colored green has a width of the given thickness; a space has a width of half the given thickness; a third band colored white has a width of half the given thickness; and a fourth band colored red has a width of half the given thickness. A fine thread 15/16 inch tap and die has a first band colored white having a width of half the given thickness; a second band colored orange has a width of the given thickness; a space has a width of half the given thickness; a third band colored white has a width of half the given thickness; and a fourth band colored red has a width of half the given thickness.

EXAMPLE 30

Coarse Thread Standard Tap and Die Set

A tap, of the tap and die set, has the second color coded indicia applied to the upper shaft of the tap, so as to display the appropriate size diameter of that particular tap, as well as, a set varied width of the second color coded indicia to indicate the coarse thread feature of that particular tap. A die from the tap and die set, has the second color coded indicia applied in a circular arrangement to the upper face of the die from the tap and die set, so as to indicate the appropriate diameter of the hole size of that particular die, as well as, using a set varied width of the second color coded indicia to indicate the coarse feature of that particular die. The first color coded indicia will be recessed and applied to the lower shaft portion of a tap, from the tap and die set so as to indicate the precise thread count of that particular tap, as well as, the first color coded indicia being recessed and applied in a circular arrangement upon the face of the die, so as to indicate the appropriate thread count of that particular die. The recognizing means for recognizing the tap or die width, as well as, recognizing the coarse thread configuration of each tap or die comprises the following scheme. A coarse thread ¼ inch, tap and die, has a first band colored white having a width of half the given thickness; a space has a width of half the given thickness; and a second band colored light blue has a width of half the given thickness. A coarse thread ⅜ inch tap and die has a first band colored green having a width of half the given thickness; a space has a width of half the given thickness; and a second band colored purple has a width of half the given thickness. A coarse thread ½ inch tap and die has a first band colored white having a width of half the given thickness; a space has a width of half the given thickness; and a second band colored yellow has a width of half the given thickness. A coarse thread ⅝ inch tap and die has a first band colored orange having a width of half the given thickness; a space has a width of half the given thickness; and a second band colored purple has a width of half the given thickness. A coarse thread ¾ inch tap and die has a first band colored green having a width of half the given thickness; a space has a width of half the given thickness; and a second band colored light blue has a width of half the given thickness. A coarse thread ⅞ inch tap and die has a first band colored gold having a width of half the given thickness; a space has a width of half the given thickness; and a second band colored purple has a width of half the given thickness. A coarse thread 5/16 inch tap and die has a first band colored orange having a width of half the given thickness; a space has a width of half the given thickness; a second band colored white has a width of half the given thickness; and a third band colored red has a width of half the given thickness. A coarse thread 7/16 inch tap and die has a first band colored gold having a width of half the given thickness; a space has a width of half the given thickness; a second band colored white has a width of half the given thickness; and a third band colored red has a width of half the given thickness. A coarse thread 9/16 inch tap and die has a first band colored dark blue having a width of half the given thickness; a space has a width of half the given thickness; a second band colored white has a width of half the given thickness; and a third band colored red has a width of half the given thickness. A coarse thread 11/16 inch tap and die has a first band colored white having a width of half the given thickness; adjoined to a second band colored black has a width one twentieth the given thickness; adjoined to a third band colored white has a width of half of the given thickness; a space has a width of half the given thickness; a fourth band colored white has a width of half the given thickness; and a fifth band colored red has a width of half the given thickness. A coarse thread 13/16 inch tap and die has a first band colored white having a width of half the given thickness; a second band colored green has a width of half the given thickness; a space has a width of half the given thickness; a third band colored white has a width of half the given thickness; and a fourth band colored red has a width of half the given thickness. A coarse thread 15/16 inch tap and die has a first band colored white having a width of half the given thickness; a second band colored orange has a width of half the given thickness; a space has a width of half the given thickness; a third band colored white has a width of half the given thickness; and a fourth band colored red has a width of half the given thickness.

EXAMPLE 31

Coarse Thread Metric Tap and Die Set

A tap, of the tap and die set, has the second color coded indicia applied to the upper shaft of the tap, so as to display the appropriate size diameter of that particular tap, as well as, a set varied width of the second color coded indicia to indicate the coarse thread feature of that particular tap. A die from the tap and die set, has the second color coded indicia applied in a circular arrangement to the upper face or the cylindrical side of the die from the tap and die set, so as to indicate the appropriate diameter of the hole size of that particular die, as well as, using a set varied width of the second color coded indicia to indicate the coarse feature of that particular die. The first color coded indicia will be recessed and applied to the lower shaft portion of a tap from the tap and die set, so as to indicate the precise thread count of that particular tap, as well as, the first color coded indicia being recessed and applied in a circular arrangement upon the face or the cylindrical side of the die, so as to indicate the appropriate thread count of that particular die. The recognizing means for recognizing the width of the tap or die, as well as, recognizing the coarse thread configuration of each tap or die comprises the following scheme. A 4 mm coarse thread tap and die has one band colored light blue has a width of half the preset thickness. A 4.5 mm coarse thread tap and die has a first band colored light blue has a width of half the preset thickness; adjoined to a second black band has a width one tenth the preset thickness; adjoined to third band colored orange has a width of one fourth the preset thickness. A 5 mm coarse thread tap and die has one band colored orange has a width of half the preset thickness. A 5.5 mm coarse thread tap and die has a first band colored orange has a width of half the preset thickness; adjoined to a second black band has a width one tenth the preset thickness; adjoined to third band colored orange has a width of fourth the preset thickness. A 6 mm coarse thread tap and die has one band colored red has a width of half the preset thickness. A 7 mm coarse thread tap and die has one band colored gold has a width of half the preset thickness. An 8 mm coarse thread tap and die has one band colored purple has a width of half the preset thickness. A 9 mm coarse thread tap and die has one band colored dark blue has a width of half the preset thickness. A 10 mm coarse thread tap and die has a first band colored white has a width of half a given thickness; adjoined to a second band colored black has a width of the identical half given thickness. An 11 mm coarse thread tap and die has a first band colored white has a width of half a given thickness; adjoined to a second black band one twentieth the given thickness; adjoined to a third band colored white has a width of the identical half given thickness. A 12 mm coarse thread tap and die has a first band colored white has a width of half a given thickness; adjoined to a second band colored yellow has a width of the identical half given thickness. A 13 mm coarse thread tap and die has a first band colored white has a width of half a given thickness; adjoined to a second band colored green has a width of the identical half given thickness. A 14 mm coarse thread tap and die has a first band colored white has a width of half a given thickness; adjoined to a second band colored light blue has a width of the identical half given thickness. A 15 mm coarse thread tap and die has a first band colored white has a width of half a given thickness; adjoined to a second band colored orange has a width of the identical half given thickness. A 16 mm coarse thread tap and die has a first band colored white has a width of a half given thickness; adjoined to a second band colored red has a width of the identical half given thickness. A 17 mm coarse thread tap and die has a first band colored white has a width of a half given thickness; adjoined to a second band colored gold has a width of the identical half given thickness. An 18 mm coarse thread tap and die has a first band colored white has a width of a half given thickness; adjoined to a second band colored purple has a width of the identical half given thickness. A 19 mm coarse thread tap and die has a first band colored white has a width of a half given thickness; adjoined to a second band colored dark blue has a width of the identical half given thickness. A 20 mm coarse thread tap and die has a first band colored yellow has a width of a half given thickness; adjoined to a second band colored black has a width of the identical half given thickness. A 21 mm coarse thread tap and die has a first band colored yellow has a width of a half given thickness; adjoined to a second band colored white has a width of the identical half given thickness. A 22 mm coarse thread tap and die has a first band colored yellow has a width of a half given thickness; adjoined to a second band colored black has a width one twentieth the set width; adjoined to a third band colored yellow has a width of the identical half given thickness.

EXAMPLE 32

Fine Thread Metric Tap and Die Set

A tap, of the tap and die set, has the second color coded indicia applied to the upper shaft of the tap, so as to display the appropriate size diameter of that particular tap, as well as, a set varied width of the second color coded indicia to indicate the fine thread feature of that particular tap. A die from the tap and die set, has the second color coded indicia applied in a circular arrangement to the upper face of the die from the tap and die set, so as to indicate the appropriate diameter of the hole size of that particular die, as well as, using a set varied width of the second color coded indicia to indicate the fine thread feature of that particular die. The first color coded indicia being recessed and applied to the lower shaft portion of a tap from the tap and die set, so as to indicate the precise thread count of that particular tap, as well as, the first color coded indicia being recessed and applied in a circular arrangement upon the face of the die, so as to indicate the appropriate thread count of that particular die. The recognizing means for recognizing the width of the tap or die, as well as, recognizing the fine thread configuration of each tap or die comprises the following scheme. A 4 mm fine thread tap and die has one band colored light blue has a width of the preset thickness. A 4.5 mm fine thread tap and die has a first band colored light blue has a width of the preset thickness; adjoined to a second black band has a width one tenth the preset thickness; adjoined to third band colored orange has a width of one fourth the preset thickness. A 5 mm fine thread tap and die has one band colored orange has a width of the preset thickness. A 5.5 mm fine thread tap and die has a first band colored orange has a width of the preset thickness; adjoined to a second black band has a width one tenth the preset thickness; adjoined to third band colored orange has a width of fourth the preset thickness. A 6 mm fine thread tap and die has one band colored red has a width of the preset thickness. A 7 mm fine thread tap and die has one band colored gold has a width of the preset thickness. An 8 mm fine thread tap and die has one band colored purple has a width of the preset thickness. A 9 mm fine thread tap and die has one band colored dark blue has a width of the preset thickness. A fine thread 10 mm tap and die has a first band one half of the given width colored white; adjoined to a second band has a width of a given thickness colored black. A fine thread 11 mm tap and die has a first band one half of the given thickness colored white; adjoined to a second band has a width of one twentieth the given thickness colored black; adjoined to a third band has a width of given thickness colored white. A fine thread 12 mm tap and die has a first band one half of the given width colored white; adjoined to a second band has a width of a given thickness colored yellow. A fine thread 13 mm tap and die has a first band one half of the given width colored white; adjoined to second band has a width of a given thickness colored green. A fine thread 14 mm tap and die has a first band one half of the given width colored white; adjoined to second band has a width of a given thickness colored light blue. A fine thread 15 mm tap and die has a first band one half of the given width colored white; adjoined to second band has a width of a given thickness colored orange. A fine thread 16 mm tap and die has a first band one half of the given width colored white; adjoined to second band has a width of a given thickness colored red. A fine thread 17 mm tap and die has a first band one half of the given width colored white; adjoined to second band has a width of a given thickness colored gold. A fine thread 18 mm tap and die has a first band one half of the given width colored white; adjoined to a second band has a width of a given thickness colored purple. A fine thread 19 mm tap and die has a first band one half of the given width colored white; adjoined to a second band has a width of a given thickness colored blue. A fine thread 20 mm tap and die has a first band one half of the given width colored yellow; adjoined to a second band has a width of a given thickness colored black. A fine thread 21 mm tap and die has a first band one half of the given width colored yellow; adjoined to second band has a width of a given thickness colored white. A fine thread 22 mm tap and die has a first band one half of the given width colored yellow; adjoined to second band has a width one twentieth the given thickness: adjoined to a third band of a given thickness colored yellow.

As to the manner of usage and operation of the present invention, the same should be apparent from the above description. Accordingly, no further discussion relating to the manner of usage and operation will be provided.

While a preferred embodiment of the color coded tool kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A color coded tool kit for allowing a user to visually identify the sizes of the various fittings of the tools in said tool kit, said color coded tool kit comprising:

a ratchet set having at least one ratchet, wherein each ratchet in said ratchet set including:

a handle;

a driver; and a first color coded indicia attached to each handle for indicating the corresponding driver size of each ratchet in said ratchet set;

a six point socket set wherein each socket in said six Point socket set having a first number of internal sides defining the nut hole in each socket in said six point socket set, said six point socket set composed of at least one socket, wherein each socket of said six point socket set including:

a first color coded indicia attached to the rear portion of each socket in said six point socket set for indicating a corresponding driver hole size of each socket in said six point socket set; and a second color coded indicia attached to a forward portion of each socket in said six point socket set for indicating the six point configuration and corresponding nut hole size of each socket in said six point socket set; and a twelve point socket set wherein each socket in said twelve point socket set having a second number of internal sides defining the nut hole in each socket in said twelve point socket set, said twelve point socket set composed of at least one socket, wherein each socket of said twelve point socket set including:

a first color coded indicia attached to the rear portion of each socket in said twelve point socket set for indicating a corresponding driver hole size of each socket in said twelve point socket set; and a second color coded indicia attached to a forward portion of each socket in said twelve point socket set for indicating the corresponding nut hole size and the twelve point configuration of each socket in said twelve point socket set;

a spline socket set wherein each socket in said spline socket set having a third number of internal sides defining the nut hole in each socket in said spline socket set, said spline socket set composed of at least one socket wherein each socket of said spline socket set including:

a first color coded indicia attached to the rear portion of each socket in said spline socket set for indicating a corresponding driver hole size of each socket in said third, spline socket set; and a first and second color coded indicia attached to a forward portion of each socket in said spline socket set for indicating the spline configuration and corresponding nut hole size, as well as, the specific spline number assigned to each socket in said spline socket set;

wherein the width of said second color coded indicia attached to any socket in any of the socket sets is proportional to the number of sides that define the corresponding nut hole in the associated socket.

2. The color coded tool kit described in claim 1 wherein the width of said second color coded indicia attached to any socket in any of the socket sets is inversely proportional to the number of sides that define the corresponding nut hole in the associated socket.

3. The color coded tool kit described in claim 1 wherein the width of said second color coded indicia attached to any socket in any of the socket sets is directly proportional to the number of sides that define the corresponding nut hole in the associated socket.

* * * * *